US007725237B2

(12) United States Patent
Yasui et al.

(10) Patent No.: US 7,725,237 B2
(45) Date of Patent: May 25, 2010

(54) CONTROL APPARATUS

(75) Inventors: Yuji Yasui, Saitama-ken (JP); Ikue Kawasumi, Saitama-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 753 days.

(21) Appl. No.: 11/635,589

(22) Filed: Dec. 8, 2006

(65) Prior Publication Data

US 2007/0142937 A1 Jun. 21, 2007

(30) Foreign Application Priority Data

Dec. 19, 2005 (JP) ..... 2005-365565

(51) Int. Cl.
*F02D 43/00* (2006.01)
*G06G 7/70* (2006.01)

(52) U.S. Cl. ..... 701/101; 701/106; 701/115

(58) Field of Classification Search ..... 701/101–106, 701/110, 112, 115
See application file for complete search history.

(56) References Cited

U.S. PATENT DOCUMENTS

| | | | | |
|---|---|---|---|---|
| 5,144,560 | A * | 9/1992 | Kurihara et al. | 701/102 |
| 5,150,300 | A * | 9/1992 | Danno et al. | 701/101 |
| 6,725,147 | B2 * | 4/2004 | Mollin | 701/104 |
| 6,785,601 | B2 * | 8/2004 | Yoshizawa et al. | 701/109 |
| 7,031,820 | B2 * | 4/2006 | Ueda et al. | 701/101 |
| 7,124,015 | B2 * | 10/2006 | Mizuno et al. | 701/109 |
| 2003/0114979 | A1 | 6/2003 | Yoshizawa et al. | |
| 2004/0199323 | A1 | 10/2004 | Mizuno et al. | |

FOREIGN PATENT DOCUMENTS

| | | | |
|---|---|---|---|
| EP | 1 486 835 | A2 | 12/2004 |
| EP | 1 643 101 | A1 | 4/2006 |
| EP | 1 857 894 | A1 | 11/2007 |
| JP | 2005-042656 | A | 2/2005 |
| JP | 2005-301764 | A | 10/2005 |
| WO | WO 03/016698 | A1 | 2/2003 |

* cited by examiner

*Primary Examiner*—Stephen K Cronin
*Assistant Examiner*—Johnny H Hoang
(74) *Attorney, Agent, or Firm*—Arent Fox LLP

(57) ABSTRACT

A control apparatus which is capable of ensuring both high-level stability and accuracy of control and reducing manufacturing costs thereof and computation load thereon, even when controlling a controlled object having extremal characteristics or a controlled object of a multi-input multi-output system. The control apparatus is comprised of an onboard model analyzer and a cooperative controller. The onboard model analyzer, based on a controlled object model defining the relationships between an intake opening angle and an exhaust reopening angle, and an indicated mean effective pressure, calculates first and second response indices and indicative of a correlation therebetween, respectively. The cooperative controller calculates the intake opening angle and the exhaust reopening angle with predetermined algorithms such that the indicated mean effective pressure is caused to converge to its target value, and determines the increasing/decreasing rate and the increasing/decreasing direction of the aforementioned angles according to the first and second response indices.

7 Claims, 15 Drawing Sheets

CONTROL APPARATUS

BACKGROUND OF THE INVENTION

1. Field of the Invention

This invention relates to a control apparatus for controlling a controlled variable of a controlled object by control inputs such that the controlled variable is caused to converge to its target value.

2. Description of the Related Art

Conventionally, as a control apparatus of this kind, the present assignee has already proposed a control apparatus disclosed in Japanese Laid-Open Patent Publication (Kokai) No. 2005-23922. The control apparatus controls the rotational speed of a driven shaft as a controlled variable by inputting a control input to a clutch mechanism as a controlled object, and includes a controller for calculating the control input. This controller calculates the control input with a target filter-type two-degree-of-freedom sliding mode control algorithm, based on a controlled object model defining the relationship between the control input and the controlled variable. The control input is input to an actuator of the clutch mechanism, and the controlled variable is controlled such that it is caused to converge to its target value.

In the control apparatus configured as above, since the control input is calculated with the target filter-type two-degree-of-freedom sliding mode control algorithm, it is possible to separately change the rate and behavior of convergence of the controlled variable to the target value for adjustment, which makes it possible to ensure both high-level stability and accuracy of control.

When the conventional control apparatus described above is applied to a controlled object having extremal characteristics, described hereinafter, or a controlled object of a multi-input multi-output system (i.e. controlled object with a plurality of control inputs and a plurality of controlled variables), there is a fear that the stability and accuracy of control are degraded.

First, when the above conventional control apparatus is applied to a controlled object having characteristics that a controlled variable thereof takes an extremum value (maximum value or minimum value) in response to a change in a control input (hereinafter referred to as "the controlled object having extremal characteristics"), if a target value of the controlled variable is set to a value larger than the maximum value of the controlled variable or a value smaller than the minimum value of the same, the controlled variable cannot reach the target value, so that the control input is calculated such that the controlled variable is changed up to the maximum value or the minimum value. As a result, the controlled variable is controlled in a direction largely deviating from the target value. That is, the control system is made unstable, and the accuracy of control is largely degraded. Such a state is more liable to occur in the controlled object of a multi-input multi-output system than in the controlled object of a one-input one-output system.

Further, in general, in the controlled object of the multi-input multi-output system, a plurality of controlled variables are often in a mutually interacting relationship. The above conventional control apparatus, however, is configured such that a single controlled variable is controlled by a single control input, and hence interaction of one control input to another can cause an unstable behavior and a degraded rate of convergence of the controlled variable to the target value. To compensate for the inconveniences, if a lot of processes are to be executed for determining conditions and searching parameter maps, the size of the control program and the amount of mapping data used in the multi-input multi-output system become immense, which requires an increased capacity of a ROM for storing the data thereof. This results not only in increased manufacturing costs but also in increased computation load due to the increased size of the executed control program and the increased amount of data processed during the operation.

SUMMARY OF THE INVENTION

The present invention has been made to provide a solution to the above-described problems, and an object thereof is to provide a control apparatus which is capable of ensuring both high-level stability and accuracy of control and reducing manufacturing costs thereof and computation load thereon, even when controlling a controlled object having extremal characteristics or a controlled object of a multi-input multi-output system.

To attain the above object, in a first aspect of the present invention, there is provided a control apparatus comprising correlation parameter-calculating means for calculating a correlation parameter indicative of a correlation between a control input and a controlled variable in a controlled object based on a controlled object model defining a relationship between the control input and the controlled variable, target value-setting means for setting a target value as a target of the controlled variable, and control input-calculating means for calculating the control input with a predetermined control algorithm such that the controlled variable is caused to converge to the target value, and determining at least one of an increasing/decreasing rate and an increasing/decreasing direction of the control input according to the correlation parameter.

With the configuration of the control apparatus according to the first aspect of the present invention, a correlation parameter indicative of a correlation between a control input and a controlled variable is calculated based on a controlled object model defining a relationship between the control input and the controlled variable in the controlled object, and the control input is calculated with a predetermined control algorithm such that the controlled variable is caused to converge to a target value thereof. At the same time, at least one of an increasing/decreasing rate and an increasing/decreasing direction of the control input is determined according to the correlation parameter. First, in the case where the increasing/decreasing rate of the control input is determined according to the correlation parameter, even when the sensitivity, i.e. the correlation of the controlled variable to the control input changes according to the value of the control input, it is possible to determine the increasing/decreasing rate of the control input according to the change in the correlation, thereby making it possible to control the controlled variable such that the controlled variable converges to its target value without causing any oscillating behavior or unstable behavior. That is, it is possible to ensure high-level stability of control.

Further, in the case where the increasing/decreasing direction of the control input is determined according to the correlation parameter, e.g. in controlling a controlled object whose controlled variable takes a maximum value in response to a change in the control input, it is possible to cause the controlled variable to accurately converge to the target value when the target value of the controlled variable is set to a value not larger than the maximum value. On the other hand, when the target value is set to a value larger than the maximum value, if the controlled variable changes across the maximum value in response to a change in the control input, the correlation between the control input and the controlled variable temporarily becomes higher, and then becomes lower, and such a change in the correlation is represented by the correlation parameter. Therefore, by determining the increasing/decreasing direction of the control input according to the correlation parameter, it is possible to hold the controlled variable close to the maximum value.

Inversely, in controlling a controlled object whose controlled variable takes a minimum value in response to a change in the control input, if the target value of the controlled variable is set to a value not smaller than the minimum value, it is possible to cause the controlled variable to accurately converge to the target value. On the other hand, even when the target value is set to a value smaller than the minimum value, if the controlled variable changes across the minimum value in response to a change in the control input, the correlation between the control input and the controlled variable becomes temporarily higher and then becomes lower again, and at the same time changes from one of a positive one and a negative one to the other, and such a change in the correlation is represented by the correlation parameter. Therefore, by determining the increasing/decreasing direction of the control input according to the correlation parameter, it is possible to hold the controlled variable close to the minimum value, thereby making it possible to ensure both high-level stability and accuracy of control. As described above, even in controlling a controlled object having extremal characteristics, if the increasing/decreasing direction of the control input is determined according to the correlation parameter, the controlled variable can be held close to the extremum value, whereby it is possible to ensure both high-level stability and accuracy of control.

Furthermore, when the increasing/decreasing rate and the increasing/decreasing direction of the control input are both determined according to the correlation parameter, it is possible to obtain all the advantageous effects described above (it should be noted that throughout the specification, the terms "calculation", "determination", and "setting" as in "calculation of the correlation parameter", "calculation or determination of the control input", and "setting of the target value" are not limited to computation of such amounts or values using a program, but includes generation of electric signals indicative of such amounts or values, using electric circuits).

Herein wherever the word "imaginary" is used it may be interpreted as "calculated."

Preferably, the correlation parameter-calculating means comprises imaginary control input-calculating means for calculating an imaginary control input as time-series data at a predetermined repetition period, by adding a periodic signal value having a predetermined periodicity to the control input, imaginary controlled variable-calculating means for calculating an imaginary controlled variable corresponding to the controlled variable to be obtained when the imaginary control input is used as the control input to the controlled object model, as time-series data, based on the controlled object model at the predetermined repetition period, and parameter-calculating means for calculating a plurality of multiplied values by multiplying a plurality of time-series data of the imaginary controlled variable by a plurality of time-series data of the periodic signal value, respectively, and calculating the correlation parameter at the predetermined repetition period based on a sum of the multiplied values.

With this configuration of the preferred embodiment, a plurality of multiplied values are calculated by multiplying a plurality of time-series data of the imaginary controlled variable by a plurality of time-series data of the periodic signal value, respectively, and the correlation parameter is calculated based on the sum of the multiplied values, so that the correlation parameter is calculated as a value close to a cross-correlation function, that is, a value representative of the correlation between the periodic signal value and the imaginary controlled variable. As a result, as the correlation between the periodic signal value and the imaginary controlled variable is higher, the absolute value of the correlation parameter becomes larger, and as the correlation therebetween is lower, the absolute value thereof becomes closer to 0, and when the correlation between the periodic signal value and the imaginary controlled variable changes from one of a positive one and a negative one to the other, the sign of the correlation parameter is inverted. Therefore, as described hereinabove, by determining the increasing/decreasing direction of the control input according to the correlation parameter, it is possible to hold the controlled variable close to an extremum value thereof. In this case, the increasing/decreasing direction of the control input is determined according to the correlation parameter, and hence the control input cannot be calculated appropriately until the calculation of the correlation parameter is completed. This makes it necessary to set a repetition period at which the control input is calculated to be longer than a repetition period at which the periodic signal value is calculated. As a consequence, the control input is calculated as a value which changes within a frequency band lower than that of the periodic signal value. In other words, the comparison between the periodic signal value and the control input shows that the periodic signal value is by far larger than the control input in the degree of reflection on both the imaginary control input and the imaginary controlled variable, so that a value indicative of the correlation between the periodic signal value and the imaginary controlled variable is indicative of the correlation between the imaginary control input and the imaginary controlled variable. This makes it possible to calculate the correlation parameter as a value accurately indicative of the correlation between the control input and the controlled variable.

Preferably, the correlation parameter-calculating means further comprises filter means for subjecting the periodic signal value and the imaginary controlled variable to a predetermined filtering process, and the parameter-calculating means calculates the multiplied values by multiplying the plurality of time-series data of the imaginary controlled variable subjected to the predetermined filtering process, by the plurality of time-series data of the periodic signal value subjected to the predetermined filtering process, respectively.

With this configuration of the preferred embodiment, the correlation parameter is calculated based on the sum of the multiplied values obtained by multiplying the plurality of time-series data of the imaginary controlled variable subjected to the predetermined filtering process, by the plurality of time-series data of the periodic signal value subjected to the predetermined filtering process, respectively. Since the imaginary control input is calculated by adding the periodic signal value to the control input, and the imaginary controlled variable is calculated as a variable to be controlled when the imaginary control input is set to a control input in the controlled object model, the imaginary controlled variable contains frequency components of the periodic signal value at a high ratio if there is a high correlation between the imaginary controlled variable and the periodic signal value. Therefore, when the correlation parameter is calculated, e.g. steady components other than the frequency components of the periodic signal value can cause an calculation error, and hence it is desirable to eliminate the steady components. On the other hand, as described hereinabove, since the control input is calculated as a value which changes within a frequency band lower than that of the periodic signal value, the control input becomes steady components of the imaginary controlled variable, and can cause a calculation error. In the present control apparatus, however, the correlation parameter is calculated using the time-series data of the periodic signal value and the imaginary controlled variable subjected to the predetermined filtering process. Therefore, by properly setting the characteristics of the predetermined filtering process, it is possible to calculate the correlation parameter more accurately while eliminating the steady components contained in the imaginary controlled variable and at the same time causing the periodic signal value and the imaginary controlled variable to match e.g. in the phase characteristics. This makes it possible, for example, even when the control input largely changes with a large change in the target value, to accurately calculate the correlation parameter while avoiding adverse influence of the change in the control input. As a result, the stability and accuracy of control can be further enhanced.

To attain the above object, in a second aspect of the present invention, there is provided a control apparatus comprising correlation parameter-calculating means for calculating a plurality of correlation parameters indicative of respective correlations between a plurality of control inputs and a controlled variable in a controlled object based on a controlled object model defining relationships between the control inputs and the controlled variable, target value-setting means for setting a target value as a target of the controlled variable, and control input-calculating means for calculating each of the control inputs with a predetermined control algorithm such that the controlled variable is caused to converge to the target value, and determining at least one of an increasing/decreasing rate and an increasing/decreasing direction of each control input according to a corresponding one of the correlation parameters.

With the configuration of the control apparatus according to the second aspect of the present invention, a plurality of correlation parameters indicative of respective correlations between a plurality of control inputs and a controlled variable are calculated based on a controlled object model defining the relationships between the control inputs and the controlled variable in the controlled object, and each of the control inputs is calculated with a predetermined control algorithm such that the controlled variable is caused to converge to the target value. At the same time at least one of the increasing/decreasing rate and the increasing/decreasing direction of each control input is determined according to a corresponding one of the correlation parameters.

First, when the increasing/decreasing rates of control inputs are determined according to respective correlation parameters, the increasing/decreasing rate of a control input having a higher correlation with the controlled variable is set to a larger value and the increasing/decreasing rate of a control input having a lower correlation with the controlled variable is set to a smaller value, whereby it is possible to cause the controlled variable to accurately converge to the target value while suppressing mutual interactions between the control inputs and causing the control inputs to cooperate with each other.

Further, when the increasing/decreasing directions of the control inputs are determined according to the respective correlation parameters, as described hereinafter, both high-level stability and accuracy of control can be ensured in controlling even a controlled object whose controlled variable takes an extremum value (maximum value or minimum value) in response to a change in any of the control inputs. Hereinafter, a control input a change in which causes the controlled variable to take an extremum value (maximum value or minimum value) is referred to as "the extremizing control input". For example, in the case where a controlled object is controlled whose controlled variable takes a maximum value in response to a change in the extremizing control input, it is possible to cause the controlled variable to accurately converge to the target value when the target value of the controlled variable is set to a value not larger than the maximum value. On the other hand, when the target value is set to a value larger than the maximum value, if the controlled variable changes across the maximum value in accordance with a change in the extremizing control input, the correlation between the extremizing control input and the controlled variable temporarily becomes higher and then becomes lower again, and at the same time changes from one of a positive one and a negative one to the other, and such a change in the correlation is represented by a correlation parameter corresponding to the extremizing control input. Therefore, by determining the increasing/decreasing direction of the extremizing control input according to the correlation parameter corresponding to the extremizing control input, it is possible to hold the controlled variable close to the maximum value, thereby making it possible to ensure both high-level stability and accuracy of control.

Further, inversely to the above, in controlling a controlled object whose controlled variable takes a minimum value in response to a change in the extremizing control input, if the target value of the controlled variable is set to a value not smaller than the minimum value, it is possible to cause the controlled variable to accurately converge to the target value. On the other hand, even when the target value is set to a value smaller than the minimum value, if the controlled variable changes across the minimum value in response to a change in the extremizing control input, the correlation between the extremizing control input and the controlled variable temporarily becomes higher and then becomes lower again, and at the same time changes from one of a positive one and a negative one to the other, and such a change in the correlation is represented by a correlation parameter corresponding to the extremizing control input. Therefore, by determining the increasing/decreasing direction of the extremizing control input according to the correlation parameter corresponding to the extremizing control input, it is possible to hold the controlled variable close to the minimum value, thereby making it possible to ensure both high-level stability and accuracy of control. As described above, even in controlling a controlled object whose controlled variable takes a maximum or minimum value in response to a change in the control input, it is possible to ensure both high-level stability and accuracy of control.

Furthermore, when the increasing/decreasing rate and the increasing/decreasing direction of each control input are both determined according to a corresponding one of the correlation parameters, it is possible to obtain all the advantageous effects described above.

Preferably, the correlation parameter-calculating means comprises imaginary control input-calculating means for calculating a plurality of imaginary control inputs as time-series data at a first predetermined repetition period by adding a plurality of periodic signal values having a predetermined periodicity to the control inputs, respectively, imaginary controlled variable-calculating means for calculating an imaginary controlled variable corresponding to the controlled variable to be obtained when the imaginary control inputs are used as the control inputs to the controlled object model, respectively, as time-series data, based on the controlled object model at the first repetition period, and parameter-calculating means for calculating a plurality of multiplied values by multiplying a plurality of time-series data of the imaginary controlled variable by a plurality of time-series data of each of the periodic signal values, respectively, and calculating each of the correlation parameters at the first repetition period based on a sum of the multiplied values.

With this configuration of the preferred embodiment, each of the correlation parameters is calculated based on the sum of the multiplied values obtained by multiplying a plurality of time-series data of the imaginary controlled variable by a plurality of time-series data of each of the periodic signal values, respectively, and therefore each correlation parameter is calculated as a value close to a cross-correlation function, that is, a value indicative of the correlation between each periodic signal value and the imaginary controlled variable. As a result, the absolute value of each correlation parameter becomes larger as the correlation between each periodic signal value and the imaginary controlled variable is higher, and becomes closer to 0 as the correlation is lower. At the same time, when the correlation between each periodic signal value and the imaginary controlled variable changes from one of a positive one and a negative one to the other, the sign of a corresponding correlation parameter is inverted. Therefore, as described hereinbefore, by determining the increasing/decreasing direction of the extremizing control input according to the correlation parameter corresponding to the extremizing control input, it is possible to hold the controlled variable close to the extremum value.

In this case, at least one of the increasing/decreasing rate and the increasing/decreasing direction of each control input is determined according to a corresponding one of the correlation parameters, and hence the control input cannot be calculated appropriately until the calculation of the correlation parameter is completed. This makes it necessary to set a repetition period at which each control input is calculated to be longer than a repetition period at which the periodic signal value is calculated. As a consequence, the control input is calculated as a value which changes within a frequency band lower than that of the periodic signal value. More specifically, the periodic signal value is by far larger than the control input in the degree of reflection on each imaginary control input and the imaginary controlled variable, so that a value indicative of the correlation between each periodic signal value and the imaginary controlled variable becomes a value indicative of the correlation between the imaginary control input and the imaginary controlled variable. This makes it possible to calculate each correlation parameter as a value accurately indicative of the correlation between the control input and the controlled variable. Further, the imaginary control inputs, the imaginary controlled variable, and the correlation parameters are all calculated using a discrete-time system model at the first predetermined repetition period (i.e. calculated onboard in real time). Therefore, in controlling controlled variable of a multi-input multi-output system by a plurality of control inputs, it is possible to reduce manufacturing costs thereof and computation load thereon compared with a control apparatus which executes a lot of processes for determining conditions and data processing of a large amount of mapping data during the operation.

More preferably, the periodic signal values have a plurality of second predetermined repetition periods different from each other, respectively, and the second repetition periods are larger than the first repetition period and are set to integral multiples of the first repetition period, a repetition period at which the control input-calculating means calculates each control input being set to an integral multiple of a least common multiple of the second repetition periods.

With this configuration of the preferred embodiment, the periodic signal values have respective second predetermined repetition periods different from each other, and hence the frequencies of the periodic signal values, which are reflected on the imaginary controlled variable, respectively, are different from each other. This makes it possible to calculate each periodic signal value as a value accurately indicative of the correlation between the periodic signal value and the imaginary controlled variable, that is, the correlation between each control input and the controlled variable. Further, the second repetition periods are set to values larger than the first repetition period, i.e. to integral multiples of the first repetition period, and the repetition period at which the control input-calculating means calculates each control input is set to an integral multiple of a least common multiple of the second repetition periods. This makes it possible to calculate the control inputs appropriately in synchronism with timing in which each correlation parameter has been positively calculated. Accordingly, during the control, even when the control inputs are separately largely changed in the same timing in accordance with a change in the target value, the correlation parameters can be calculated with accuracy, whereby it is possible to cause the controlled variable to accurately converge to the target value while avoiding e.g. a mutual interaction between the control inputs. Further, even when the control system is in a steady state, it is possible to avoid the increasing/decreasing rate and/or the increasing/decreasing direction of each control input from being made oscillating by the adverse influences of each periodic signal value, thereby making it possible to ensure high-level stability of control.

Preferably, the correlation parameter-calculating means further comprises filter means for subjecting each periodic signal value and the imaginary controlled variable to a predetermined filtering process, and the parameter-calculating means calculates the multiplied values by multiplying the plurality of time-series data of the imaginary controlled variable subjected to the predetermined filtering process, by the plurality of time-series data of each periodic signal value subjected to the predetermined filtering process, respectively.

With this configuration of the preferred embodiment, each of the correlation parameters is calculated based on the sum of a plurality of multiplied values obtained by multiplying the plurality of time-series data of the imaginary controlled variable subjected to the predetermined filtering process, by the plurality of time-series data of each periodic signal value subjected to the predetermined filtering process, respectively. Each imaginary control input is calculated by adding a periodic signal value to the control input, and the imaginary controlled variable is calculated as a controlled variable to be obtained when the imaginary control input is used as the control input in the controlled object model, and therefore the imaginary controlled variable contains frequency components of each periodic signal value at a high ratio if there is a high correlation between the imaginary controlled variable and the periodic signal value. Therefore, when the correlation parameter is calculated, there is a possibility of e.g. steady components other than the frequency components of the periodic signal value causing a calculation error, and hence it is desirable to eliminate the steady components. On the other hand, as described hereinabove, since the control input is calculated as a value which changes within a frequency band lower than that of the periodic signal value, the control input becomes a steady component of the imaginary controlled variable, and can cause a calculation error. In contrast, the present control apparatus calculates the correlation parameter using the time-series data of each periodic signal value and the imaginary controlled variable, both subjected to the predetermined filtering process, and hence by properly setting the characteristics of the predetermined filtering process, it is possible to calculate the correlation parameter more accurately while eliminating the steady components contained in the imaginary controlled variable, and at the same time causing the periodic signal value and the imaginary controlled variable to match in the phase characteristics. This makes it possible, for example, even when the control inputs largely change with a large change in the target value, to accurately calculate the correlation parameters while avoiding adverse influence of the change in the control inputs. As a result, the stability and accuracy of control can be further enhanced.

Preferably, the controlled object is an internal combustion engine.

In general, the engine is a controlled object of the multi-input multi-output system, and hence with this configuration of the preferred embodiment, in controlling the controlled object of the multi-input multi-output system, it is possible to obtain the advantageous effects as described above.

The above and other objects, features, and advantages of the present invention will become more apparent from the following detailed description taken in conjunction with the accompanying drawings.

DETAILED DESCRIPTION OF PREFERRED EMBODIMENTS

Hereafter, a control apparatus according to an embodiment of the present invention will be described with reference to the drawings. The control apparatus 1 controls an internal combustion engine (hereinafter simply referred to as "the engine") 3 shown in FIG. 1, and includes an ECU 2 as shown in FIG. 2. As described hereinafter, the ECU 2 carries out various control processes for controlling an indicated mean effective pressure Pmi (i.e. generated torque) and so forth, depending on operating conditions of the engine 3.

Figure 1:
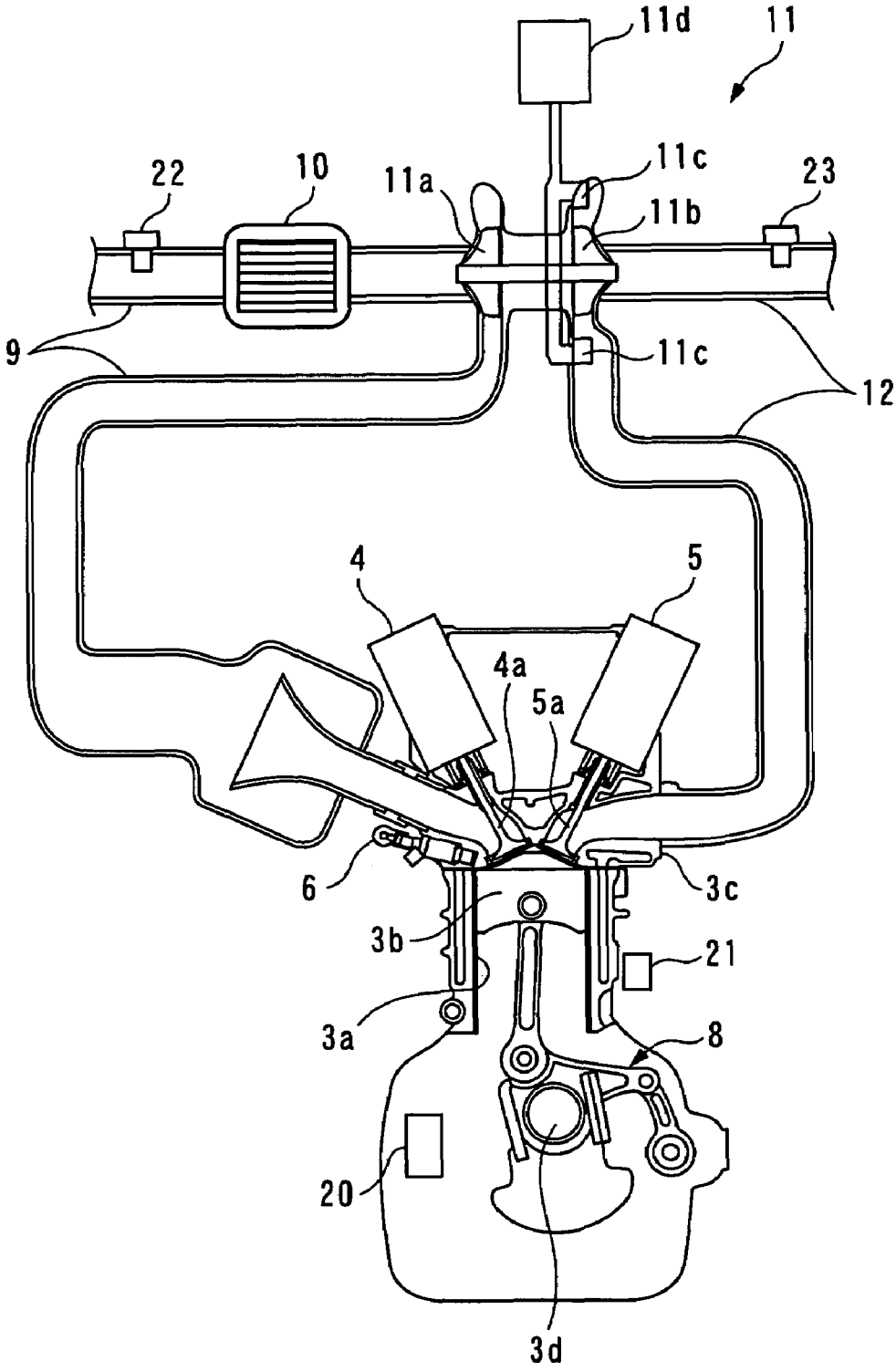
FIG. 1 is a schematic diagram of an internal combustion engine to which is applied a control apparatus according to the present invention.
Figure 2:
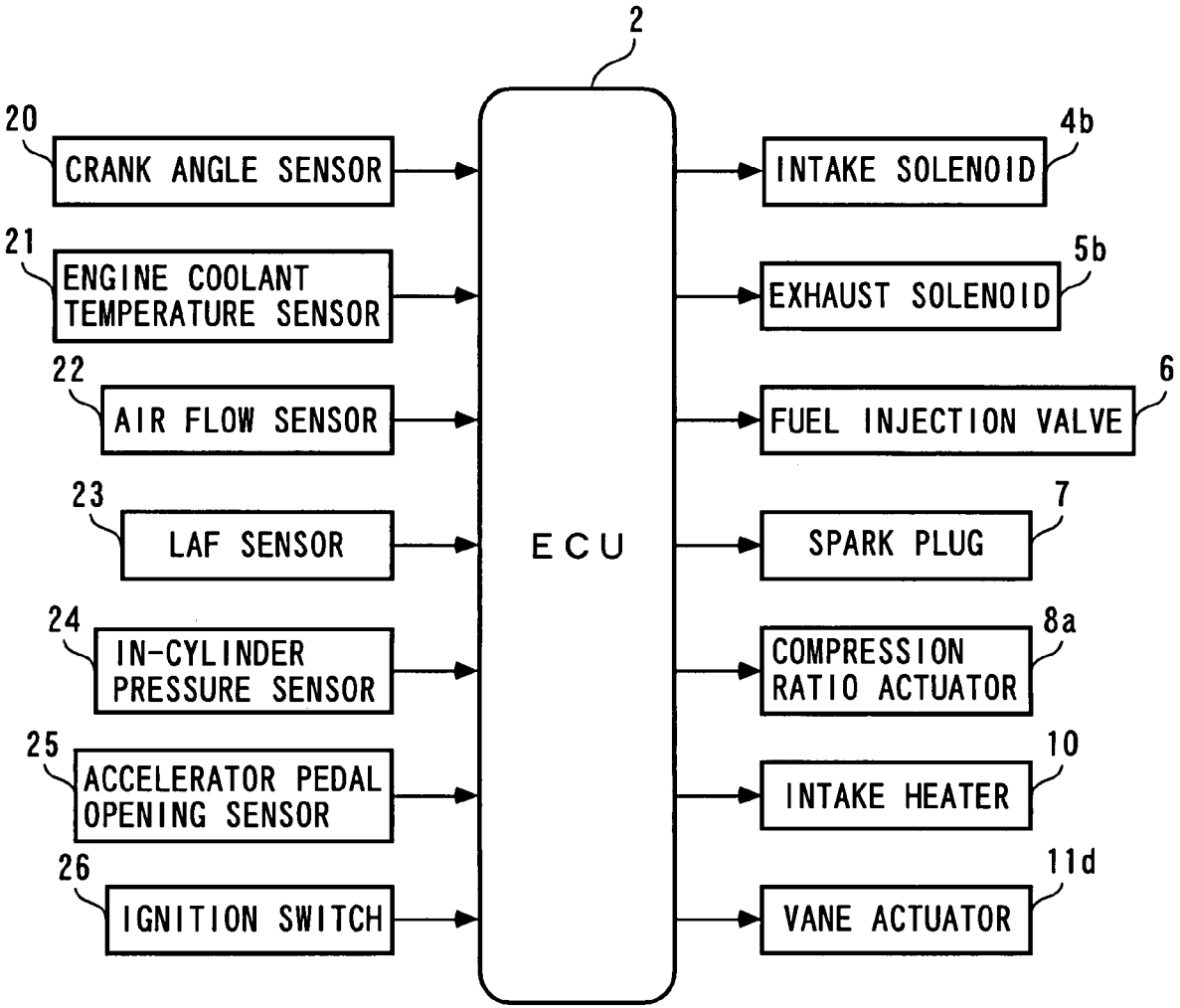
FIG. 2 is a schematic diagram of the control apparatus.

Referring to FIG. 1, the engine 3 is an in-line four-cylinder gasoline engine that includes a four pairs of cylinders 3*a* and pistons 3*b* (only one pair of which is shown), and is installed on a vehicle, not shown. The engine 3 is capable of performing HCCI (Homogeneous Charge Compression Ignition) operation, that is, compression ignition combustion operation. More specifically, within a predetermined compression ignition operating region, the engine 3 is operated in compression ignition combustion, whereas in a spark ignition operating region other than the compression ignition region, the engine 3 is operated in spark ignition combustion.

The engine 3 includes, on a cylinder-by-cylinder basis, a variable intake valve-actuating mechanism 4, a variable exhaust valve-actuating mechanism 5, a fuel injection valve 6 (FIG. 2 shows only one), and a spark plug 7 (FIG. 2 shows only one). The variable intake valve-actuating mechanism 4 is of an electromagnetic type that actuates an intake valve 4*a* by an electromagnetic force to open and close the same, and is comprised of a coil spring for urging the intake valve 4*a* in the valve-closing direction, an intake solenoid 4*b* (FIG. 2 shows only one) electrically connected to the ECU 2.

In the variable intake valve-actuating mechanism 4, when the intake solenoid 4*b* is in a deenergized state, the intake valve 4*a* is held in the valve-closing position by the urging force of the coil spring. Further, when the intake solenoid 4*b* is energized by the ECU 2, the intake valve 4*a* is actuated by the electromagnetic force of the intake solenoid 4*b* in the valve-opening direction against the urging force of the coil spring, and is held in an open state, whereas when the intake solenoid 4*b* is deenergized, the intake valve 4*a* is returned to a closed state by the urging force of the coil spring.

Figure 3:
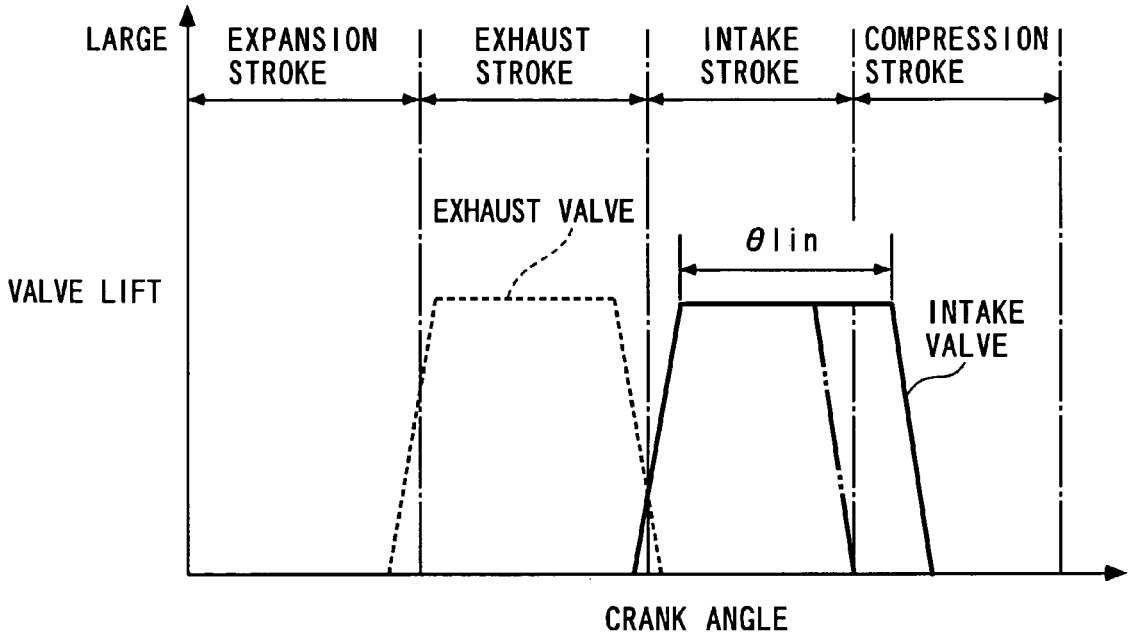
FIG. 3 is a diagram of valve lift curves of an intake valve, which is useful in explaining a valve-opening operation performed by a variable intake valve-actuating mechanism for opening the intake valve.

With the above configuration, as shown in FIG. 3, the intake valve 4*a* has the valve-opening timing and valve-closing timing thereof freely changed by the variable intake valve-actuating mechanism 4, and has a valve lift curve having a substantially trapezoid-like shape. In the present embodiment, the ECU 2 holds constant the valve-opening timing of the intake valve 4*a*, and controls the valve-closing timing of the same between late closing timing indicated by a solid line in FIG. 3, and early closing timing indicated by a two-dot chain line in FIG. 3. It should be noted that in the following description, during the valve open time period of the intake valve 4*a*, a duration over which a crankshaft of the engine 3 rotates through crank angles capable of holding the intake valve 4*a* at its maximum lift is referred to as "the intake opening angle θlin" (see FIG. 3).

Similarly to the variable intake valve-actuating mechanism 4, the variable exhaust valve-actuating mechanism 5 is of an electromagnetic type that actuates an exhaust valve 5*a* by an electromagnetic force to open and close the same, and includes a coil spring for urging the exhaust valve 5*a* in the valve-closing direction, an exhaust solenoid 5*b* (FIG. 2 shows only one) electrically connected to the ECU 2, and so forth.

In the variable exhaust valve-actuating mechanism 5, when the exhaust solenoid 5*b* is in a deenergized state, the exhaust valve 5*a* is held in the valve-closing position by the urging force of the coil spring. Further, when the exhaust solenoid 5*b* is energized by the ECU 2, the exhaust valve 5*a* is actuated by the electromagnetic force of the exhaust solenoid 5*b* in the valve-opening direction against the urging force of the coil spring, and is held in an open state, whereas when the exhaust solenoid 5*b* is deenergized, the exhaust valve 5*a* is returned to a closed state by the urging force of the coil spring.

Figure 4:
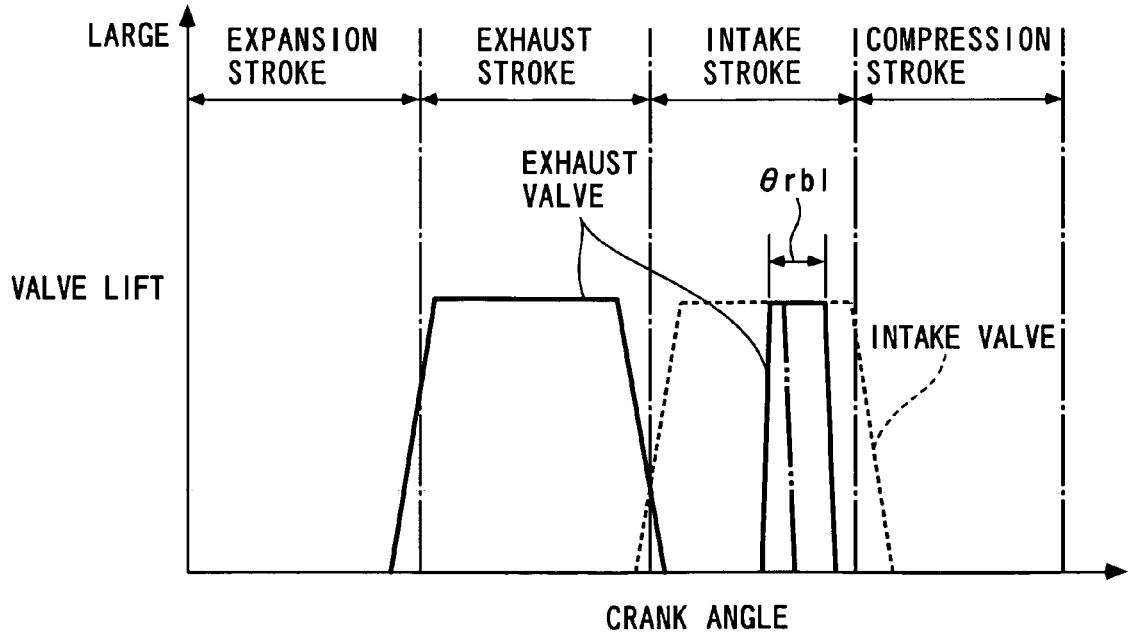
FIG. 4 is a diagram of valve lift curves of an exhaust valve, which is useful in explaining a valve-opening operation performed by a variable exhaust valve-actuating mechanism for opening the exhaust valve.

With the above configuration, as shown in FIG. 4, the exhaust valve 5*a* has the valve-opening timing and valve-closing timing thereof freely changed by the variable exhaust valve-actuating mechanism 5, and has a valve lift curve having a substantially trapezoid-like shape. In the present embodiment, as shown in FIG. 4, the ECU 2 controls the exhaust valve 5*a* such that the exhaust valve 5*a* is opened during the normal exhaust stroke in one combustion cycle, and is reopened during the suction stroke as well.

In this case, the valve timing of the exhaust valve 5*a* is held constant during the exhaust stroke. On the other hand, in the valve-reopening operation during the intake stroke, the exhaust valve 5*a* has its valve-opening timing held constant, and its valve-closing timing controlled between late closing timing indicated by a solid line in FIG. 4, and early closing timing indicated by a two-dot chain line in FIG. 4. The valve-reopening operation of the exhaust valve 5*a* is carried out so as to draw in exhaust gases emitted from an adjacent cylinder 3*a* into the cylinder 3*a* to thereby raise the temperature of a mixture within the combustion chamber high enough for performing compression ignition combustion. It should be noted that in the following description, during valve-reopening operation of the exhaust valve 5*a*, a duration over which the crankshaft of the engine 3 rotates through crank angles capable of holding the exhaust valve 5*a* at its maximum lift is referred to as "the exhaust reopening angle θrbl" (see FIG. 4).

The fuel injection valve 6 is mounted through an associated one of cylinder heads 3*c* so as to inject fuel directly into the associated cylinder 3*a*. In short, the engine 3 is configured as a direct injection engine. Further, the fuel injection valve 6 is electrically connected to the ECU 2, and has its valve open time period and valve-opening timing controlled by the ECU 2. That is, the ECU 2 performs fuel injection control of the fuel injection valve 3.

Further, the spark plug 7 as well is electrically connected to the ECU 2, and when the engine 3 is in the above-described spark ignition operating region, the spark plug 7 has its discharge state controlled by the ECU 2, for burning a mixture within the associated combustion chamber in ignition timing. That is, the ECU 2 performs ignition timing control of the spark plug 7.

Furthermore, the engine 3 is provided with a variable compression ratio mechanism 8, a crank angle sensor 20, and an engine coolant temperature sensor 21. The variable compression ratio mechanism 8 is configured similarly to one proposed by the present assignee in Japanese Laid-Open Patent Publication (Kokai) No. 2005-273634, which is incorporated herein by reference, and hence detailed description thereof is omitted, but it changes the top dead center position of the piston 3*b*, that is, the stroke of the piston 3*b*, to thereby continuously change a compression ratio Cr within a predetermined range. The variable compression ratio mechanism 8 includes a compression ratio actuator 8*a* electrically connected to the ECU 2 (see FIG. 2). The ECU 2 drives the variable compression ratio mechanism 8 via the compression ratio actuator 8*a* to thereby control the compression ratio Cr such that the compression ratio Cr becomes equal to a target compression ratio Cr_cmd.

The crank angle sensor 20 is formed by a combination of a magnet rotor and an MRE pickup, and delivers a CRK signal and a TDC signal, which are both pulse signals, to the ECU 2 in accordance with rotation of the crankshaft 3*d*.

Each pulse of the CRK signal is generated whenever the crankshaft rotates through 1°. The ECU 2 determines a rotational speed (hereinafter referred to as "the engine speed") NE of the engine 3, based on the CRK signal. The TDC signal indicates that the piston 3*b* has come to a predetermined crank angle position immediately before the TDC position at the start of the intake stroke, on a cylinder-by-cylinder basis, and in the four-cylinder engine 3 according to the present embodiment, each pulse of the TDC signal is generated whenever the crankshaft rotates through 180°.

The engine coolant temperature sensor 21 senses an engine coolant temperature TW which is the temperature of an engine coolant circulating through a cylinder block of the engine 3, and delivers a signal indicative of the sensed engine coolant temperature TW to the ECU 2.

In an intake passage 9 of the engine 3, there are arranged an air flow sensor 22, an intake heater 10, and a turbocharger 11 from upstream to downstream in the mentioned order at respective locations of the intake passage 9. The air flow sensor 22 is implemented by a hot-wire air flow meter, and detects a flow rate of air flowing through the intake passage 9 to deliver a signal indicative of the sensed air flow rate to the ECU 2. The ECU 2 calculates the amount of air drawn into the cylinder 3*a* based on the signal from the air flow sensor 22.

The intake heater 10 is electrically connected to the ECU 2, and when turned on by the ECU 2, heats air flowing through the intake passage 9 to raise the temperature thereof.

Further, the turbocharger 11 is comprised of a compressor blade 11*a* disposed at a location downstream of the air flow sensor 22 in the intake passage 9, a turbine blade 11*b* disposed in an intermediate portion of an exhaust passage 12, for rotating in unison with the compressor blade 11*a*, a plurality of variable vanes 11*c* (only two of which are shown), and a vane actuator 11*d* for actuating the variable vanes 11*c*.

In the turbocharger 11, when the turbine blade 11*b* is driven for rotation by exhaust gases flowing through the exhaust passage 12, the compressor blade 11*a* integrally formed with the turbine blade 11*b* is also rotated, whereby air within the intake passage 9 is pressurized. In short, supercharging is carried out.

Further, the variable vanes 11*c* change boost pressure generated by the turbocharger 11, and are pivotally mounted on a wall of a turbine blade-accommodating portion of a housing. The ECU 2 changes the degree of opening of the variable vanes 11*c* via the vane actuator 11*d* to change the amount of gases blown to the turbine blade 11*b*, whereby the rotational speed of the turbine blade 11*b*, that is, the rotational speed of the compressor blade 11*a* is changed to control the boost pressure Pc such that it becomes equal to a target boost pressure Pc_cmd.

A LAF sensor 23 is disposed at a location downstream of the turbine blade 11*b* in the exhaust passage 12 of the engine 3. The LAF sensor 23 is comprised of a zirconia layer and platinum electrodes, and linearly detects the concentration of oxygen in exhaust gases flowing through the exhaust passage 12, in a broad air-fuel ratio range from a rich region richer than a stoichiometric air-fuel ratio to a very lean region, and delivers a signal indicative of the sensed oxygen concentration to the ECU 2. The ECU 2 calculates a detected air-fuel ratio AF indicative of the air-fuel ratio in exhaust gases, based on the value of the signal from the LAF sensor 23, and controls the detected air-fuel ratio AF such that it becomes equal to a target air-fuel ratio AF_cmd.

Further, as shown in FIG. 2, to the ECU 2 are connected in-cylinder pressure sensors 24, an accelerator pedal opening sensor 25, and an ignition switch (hereinafter referred to as "the IG·SW") 26. The in-cylinder pressure sensors 24 are of a piezoelectric element type integrally formed with an associated one of the spark plugs 7, and are provided on a cylinder-by-cylinder basis (only one of which is shown). The in-cylinder pressure sensor 24 is bent with a change in pressure in each cylinder 3*a*, i.e., in-cylinder pressure Pcyl, thereby detecting the in-cylinder pressure Pcyl to deliver a signal indicative of the sensed in-cylinder pressure Pcyl to the ECU 2. The ECU 2 calculates the indicated mean effective pressure Pmi (i.e. generated torque) based on the signal from the in-cylinder pressure sensor 24.

The accelerator pedal opening sensor 25 detects a stepped-on amount AP of an accelerator pedal, not shown, of the vehicle (hereinafter referred to as "the accelerator pedal opening AP") and delivers a signal indicative of the sensed accelerator pedal opening AP to the ECU 2. Further, the IG·SW 28 is turned on or off by operation of an ignition key, not shown, and delivers a signal indicative of the ON/OFF state thereof to the ECU 2.

The ECU 2 is implemented by a microcomputer comprised of a CPU, a RAM, a ROM, and an I/O interface (none of which are specifically shown). The ECU 2 determines operating conditions of the engine 3, based on the signals from the aforementioned sensors 20 to 25 and the ON/OFF signal from the IG·SW 26, and executes the control processes. More specifically, the ECU 2 controls the indicated mean effective pressure Pmi and so forth according to the operating conditions of the engine 3, as described hereinafter.

It should be noted that in the present embodiment, the CPU 2 corresponds to correlation parameter-calculating means, target value-setting means, control input-calculating means, imaginary control input-calculating means, imaginary controlled variable-calculating means, parameter-calculating means, and filter means.

Figure 5:
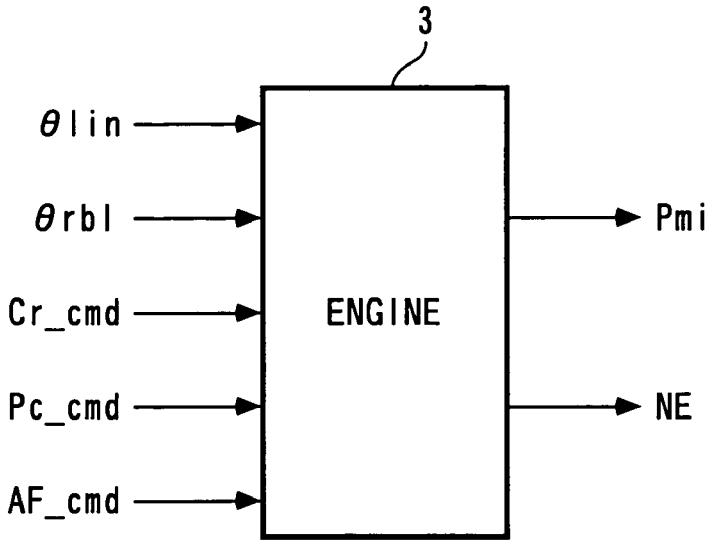
FIG. 5 is a diagram of control inputs and controlled variables input to and output from the engine regarded as a controlled object of a multi-input multi-output system.

Next, a description will be given of the control apparatus 1 according to the present embodiment. As described hereinafter, the control apparatus 1 controls the indicated mean effective pressure Pmi using the intake opening angle θlin and the exhaust reopening angle θrbl by regarding the engine 3 as a controlled object to which the intake opening angle θlin and the exhaust reopening angle θrbl are input as control inputs and from which the indicated mean effective pressure Pmi is output as a controlled variable, for the following reason:

First, when the engine 3 in the present embodiment is studied as shown in FIG. 5, as a controlled object, the two parameters Pmi and NE vary with changes in the five parameters θlin, θrbl, Cr_cmd, Pc_cmd, and AF_cmd, and therefore the engine 3 can be regarded as a so-called multi-input multi-output system that controls two controlled variables by five control inputs. Further, in the case of the engine 3 in the present embodiment, the intake heater 10 is controlled such that the amount of heat generated thereby is constant, due to low responsiveness in a transient state thereof, and hence in the control system shown in FIG. 5, the operating condition of the intake heater 10 is not taken into account.

Now, when attention is paid to the indicated mean effective pressure Pmi as the controlled variable, in the engine 3 operated in the compression ignition combustion as in the present embodiment, control of the temperature of a mixture within the combustion chamber is the most important factor of the compression ignition combustion, and hence the intake opening angle θlin and the exhaust reopening angle θrbl are the most important control inputs that have the most significant influence on the control of the engine 3. For the above reason, in the control apparatus 1, the engine 3 is modeled as a response surface model shown in FIG. 6 for use as a controlled object model, by assuming that the engine speed NE, the boost pressure Pc, and the detected air-fuel ratio AF are constant, and regarding the engine 3 as a controlled object to which the intake opening angle θlin and the exhaust reopening angle θrbl are input as control inputs and from which the indicated mean effective pressure Pmi is output as the controlled variable.

Figure 6:
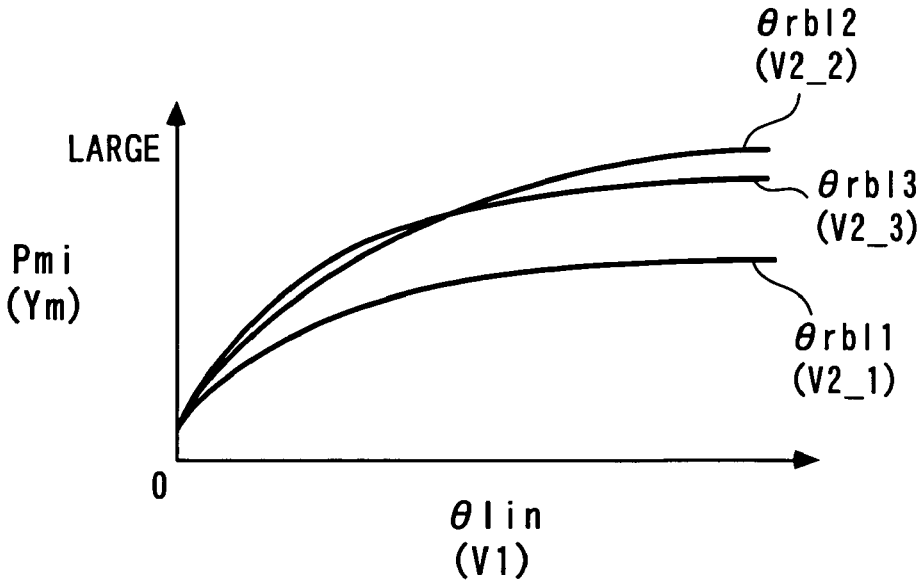
FIG. 6 is a diagram of a controlled object model formed by regarding the engine as a controlled object from which an indicated mean effective pressure Pmi is output as a controlled variable, and to which an intake opening angle θlin and an exhaust reopening angle θrbl are input as control inputs.

In FIG. 6, θrbl1 to θrbl3 represent predetermined values of the exhaust reopening angle θrbl, and are set to values which satisfy the relationship of θrbl1<θrbl2<θrbl3. In the response surface model, the indicated mean effective pressure Pmi is set such that it assumes a larger value as the intake opening angle θlin is larger. This is because as the intake opening angle θlin is larger, the amount of intake air increases. Further, in a region where the intake opening angle θlin is large, the indicated mean effective pressure Pmi is set such that it assumes its maximum value with respect to the direction of increasing or decreasing the exhaust reopening angle θrbl. This is because in the region where the intake opening angle θlin is large, the degree or rate of a rise in the temperature of the mixture, dependent on the intake opening angle θlin, is large, so that even when the exhaust reopening angle θrbl is increased or decreased, the degree of contribution of the exhaust reopening angle θrbl to the rise in the temperature of the mixture is smaller to cause the indicated mean effective pressure Pmi to cease to increase, and further if the exhaust reopening angle θrbl is increased to some extent or more, ignition timing (spontaneous ignition timing) becomes too early (before the top dead center) to thereby suppress the maximum in-cylinder pressure during the compression stroke of the engine 3.

It should be noted that when an imaginary controlled variable Ym, referred to hereinafter, is calculated, a controlled object model is used in which the intake opening angle θlin is replaced by a first imaginary control input V1, and the three predetermined values θrbl to θrbl3 of the exhaust reopening angle θrbl by three predetermined values V2_1 to V2_3 (V2_1<V2_2<V2_3) of a second imaginary control input V2, respectively, as indicated by abbreviation symbols in parentheses in FIG. 6.

Figure 7:
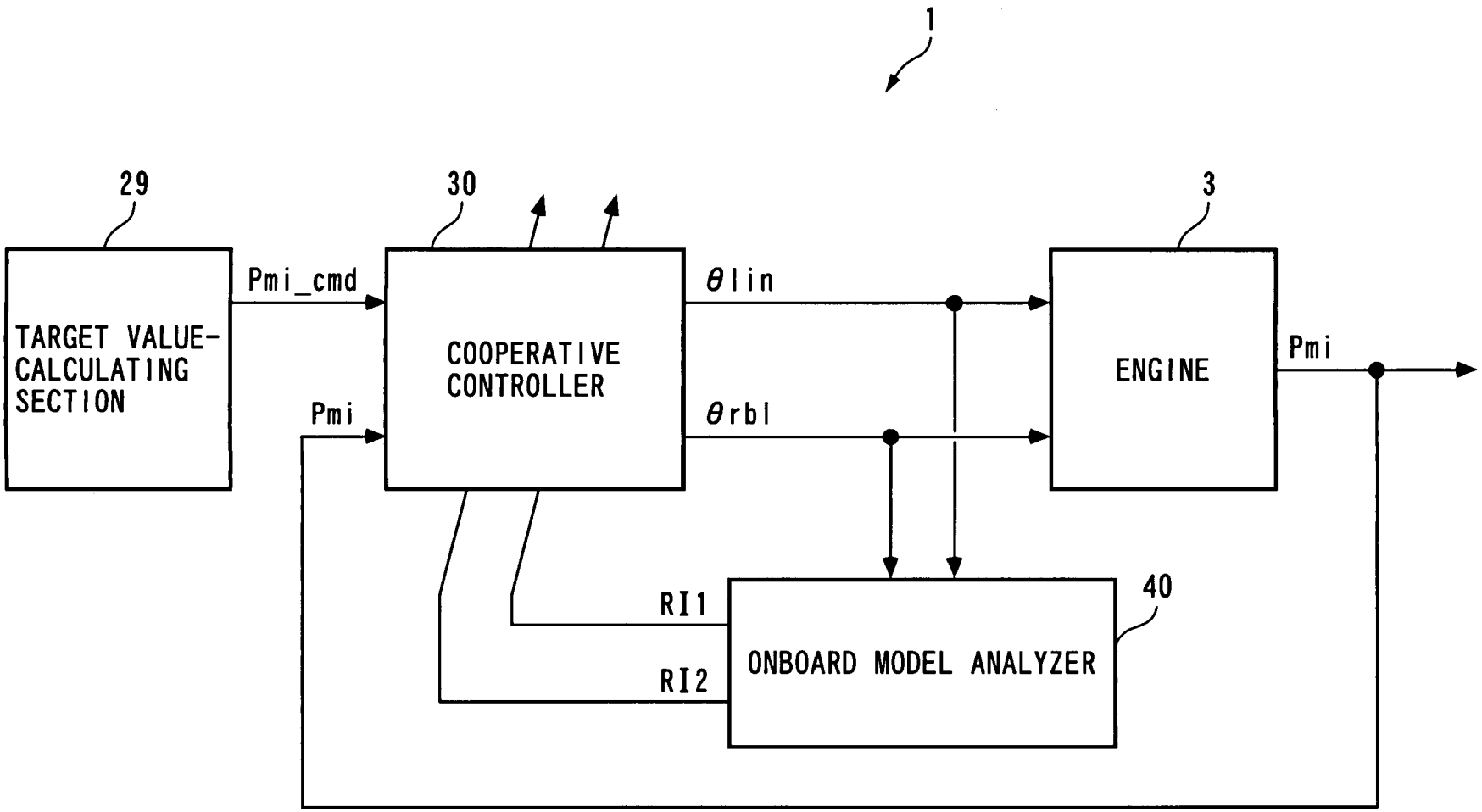
FIG. 7 is a schematic functional block diagram of the control apparatus.

Next, a description will be given of details of the construction of the control apparatus 1. Referring to FIG. 7, the control apparatus 1 is comprised of a target value-calculating section 29, a cooperative controller 30, and an onboard model analyzer 40, all of which are implemented by the ECU 2.

First, the target value-calculating section 29 calculates a target value Pmi_cmd of the indicated mean effective pressure by searching a map shown in FIG. 17, described hereinafter, according to the engine speed NE and the accelerator pedal opening AP. It should be noted that in the present embodiment, the target value-calculating section 29 corresponds to the target value-setting means.

Further, the cooperative controller 30 calculates the intake opening angle θlin and the exhaust reopening angle θrbl using two response indices RI1 and RI2 calculated by the onboard model analyzer 40, as described hereinafter, such that the indicated mean effective pressure Pmi is caused to converge to its target value Pmi_cmd. It should be noted that in the present embodiment, the cooperative controller 30 corresponds to the control input-calculating means.

On the other hand, as described hereinafter, the onboard model analyzer 40 calculates the first and second response indices RI1 and RI2 using the intake opening angle θlin and the exhaust reopening angle θrbl calculated by the cooperative controller 30. It should be noted that in the present embodiment, the onboard model analyzer 40 corresponds to the correlation parameter-calculating means, the imaginary control input-calculating means, the imaginary controlled variable-calculating means, the parameter-calculating means, and the filter means, and the first and second response indices RI1 and RI2 correspond to correlation parameters.

Figure 8:
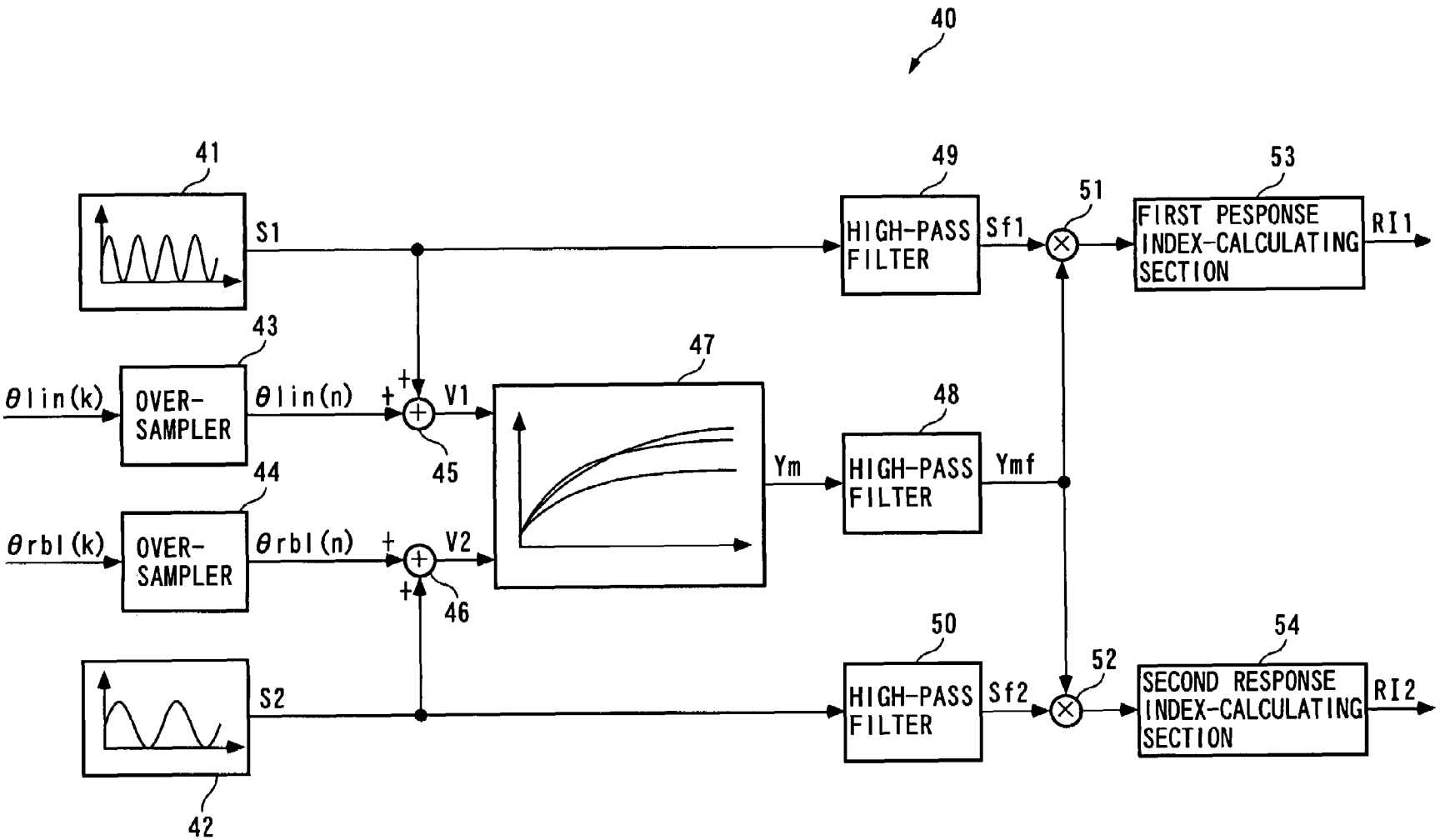
FIG. 8 is a schematic functional block diagram of an onboard model analyzer.

Referring to FIG. 8, the onboard model analyzer 40 is comprised of a first periodic signal value-calculating section 41, a second periodic signal value-calculating section 42, two oversamplers 43 and 44, two adders 45 and 46, an imaginary controlled variable-calculating section 47, three high-pass filters 48 to 50, two multipliers 51 and 52, a first response index-calculating section 53, and a second response index-calculating section 54.

It should be noted that in Equations (1) to (9) referred to hereinafter, discrete data with a symbol (n) indicates that it is data sampled or calculated at a predetermined control period ΔTn (at a repetition period during which a total of five consecutive pulses of the CRK signal are generated, i.e. whenever the crankshaft rotates through 5°), and the symbol n indicates a position in the sequence of sampling or calculating cycles of discrete data. For example, the symbol n indicates that discrete data therewith is a value sampled or calculated in the current control timing, and a symbol n−1 indicates that discrete data therewith is a value sampled or calculated in the immediately preceding control timing. This also applies to the following discrete data. Further, in the following description, the symbol (n) and the like provided for the discrete data are omitted as deemed appropriate. It should be noted that in the present embodiment, the predetermined control period ΔTn corresponds to a predetermined repetition period and a first predetermined repetition period.

First, the onboard model analyzer 40 calculates first and second periodic signal values S1 and S2 by the first and second periodic signal value-calculating sections 41 and 42 using the following Equations (1) and (2).

$$S1(n)=A1\cdot S1'(n) \tag{1}$$

$$S2(n)=A2\cdot S2'(n) \tag{2}$$

Figure 9:
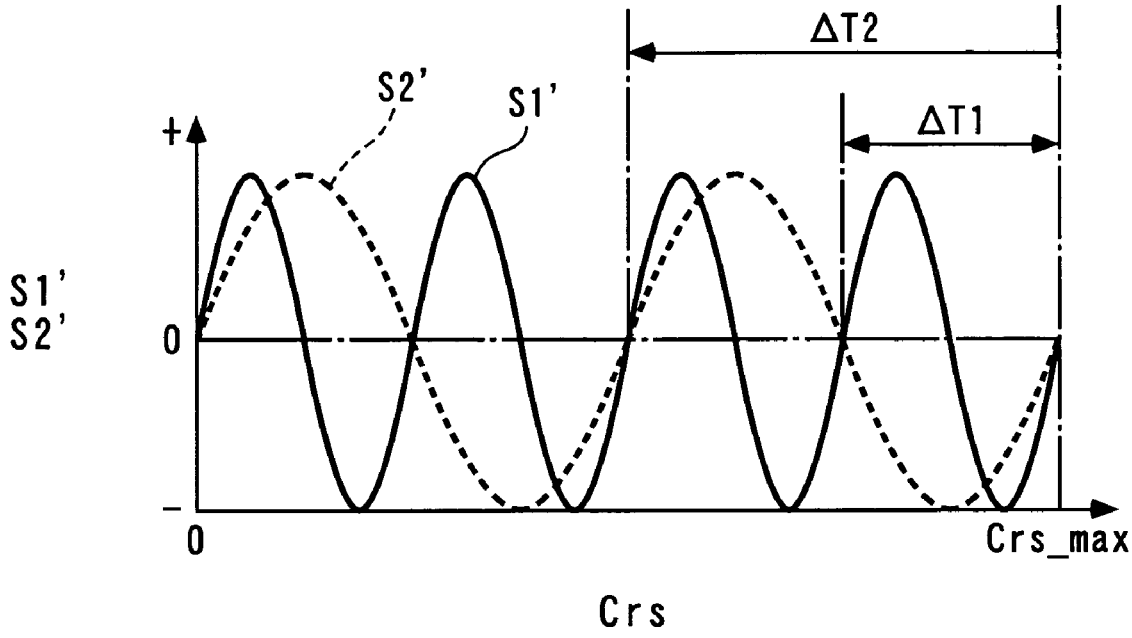
FIG. 9 is a view of an example of a map for use in calculation of respective basic values S1' and S2' of first and second periodic signal values.

In the above Equation (1), A1 represents a first predetermined amplitude gain, and S1' represents a basic value of the first periodic signal value, which is calculated by searching a map shown in FIG. 9, according to a counter value Crs. As described hereinafter, the counter value Crs is counted up from 0 to its maximum value Crs_max by incrementing 1 per the control period ΔTn. When the counter value Crs reaches the maximum value Crs_max, it is reset to 0. It should be noted that a repetition period at which the basic value S1' of the first periodic signal value is calculated, i.e. the repetition period ΔT1 at which the first periodic signal value S1 is calculated is set such that ΔT1=ΔTn·(Crs_max/N1) hold wherein Crs_max is a multiple of 4, not smaller than a value of 8, and N1 is a multiple of 4, not smaller than a value of 4. In the case of the present embodiment, the repetition period ΔT1 (second repetition period) is set to a crank angle of 45° by setting Crs_max=36 and N1=4.

Further, in the above Equation (2), A2 represents a second predetermined amplitude gain, and S2' represents a basic value of the second periodic signal value and is calculated by searching the map shown in FIG. 9, according to the counter value Crs. It should be noted that a repetition period at which the basic value S2' of the second periodic signal value is calculated, i.e. the repetition period ΔT2 at which the second periodic signal value S2 is calculated is set such that ΔT2=ΔTn·(Crs_max/N2) holds wherein Crs_max is a multiple of 4, not smaller than a value of 8, and, and N2 is a multiple of 2, which is set such that N2<N1 holds. In the case of the present embodiment, the repetition period ΔT2 (second repetition period) is set to a crank angle of 90° by setting Crs_max=36 and N2=2.

Further, the oversamplers 43 and 44 oversample an intake opening angle θlin(k) and an exhaust reopening angle θrbl(k) at the aforementioned control period ΔTn, to thereby calculate respective oversampled values θlin(n) and θrbl(n) of the intake opening angle and the exhaust reopening angle. It should be noted that the intake opening angle θlin(k) and the exhaust reopening angle θrbl(k) are calculated by the cooperative controller 30 at a predetermined control period ΔTk (repetition period at which the control input is calculated) longer than the control period Tn.

Then, the adders 45 and 46 calculate the first and second imaginary control inputs V1 and V2 using the following Equations (3) and (4):

$$V1(n)=S1(n)+\theta lin(n) \tag{3}$$

$$V2(n)=S2(n)+\theta rbl(n) \tag{4}$$

Furthermore, the imaginary controlled variable-calculating section 47 calculates the imaginary controlled variable Ym. More specifically, a controlled object model is used which is formed by replacing the intake opening angle θlin and the three predetermined values θrbl1 to θrbl3 of the exhaust reopening angle θrbl in the FIG. 6 controlled object model described above by the first imaginary control input V1 and the three predetermined values V2_1 to V2_3 of the second imaginary control input V2, respectively, and to this controlled object model is applied the first and second imaginary control inputs V1 and V2 calculated as above, whereby the imaginary controlled variable Ym is calculated.

Subsequently, the high-pass filter 48 calculates a filtered value Ymf of the imaginary controlled variable through a high-pass filtering process expressed by the following Equation (5):

$$\begin{aligned}Ymf(n)=&b0\cdot Ym(n)+b1\cdot Ym(n-1)+\ldots+bm^*\cdot Ym(n-m^*)+\\&a1\cdot Ymf(n-1)+a2\cdot Ymf(n-2)+\ldots+ak^*\cdot Ymf(n-k^*)\end{aligned} \tag{5}$$

In the above Equation (5), b0 to bm* and a0 to ak* represent predetermined filter coefficients, and m* and k* predetermined integers.

On the other hand, the high-pass filters 49 and 50 calculate filtered values Sf1 and Sf2 of the first and second periodic signal values through high-pass filtering processes expressed by the following Equations (6) and (7), respectively.

$$\begin{aligned}Sf1(n)=&b0\cdot S1(n)+b1\cdot S1(n-1)+\ldots+bm^*\cdot S1(n-m^*)+\\&a1\cdot Sf1(n-1)+a2\cdot Sf1(n-2)+\ldots+ak^*\cdot Sf1(n-k^*)\end{aligned} \tag{6}$$

$$Sf2(n)=b0\cdot S2(n)+b1\cdot S2(n-1)+\ldots+bm^*\cdot S2(n-m^*)+a1\cdot Sf2(n-1)+a2\cdot Sf2(n-2)+\ldots+ak^*\cdot Sf2(n-k^*) \quad (7)$$

Then, the multipliers 51 and 52 calculate multiplied values Ymf·Sf1 and Ymf·Sf2 by multiplying the filtered value Ymf of the imaginary controlled variable by the respective filtered values Sf1 and Sf2 of the first and second periodic signal values. Then, the first and second response index-calculating sections 53 and 54 calculate the first and second response indices RI1 and RI2 based on h+1 (h=Crs_max) time-series data of the multiplied values Ymf·Sf1 and Ymf·Sf2, using the following Equations (8) and (9), respectively.

$$RI1(n) = Kr1 \cdot \sum_{j=n-h}^{n} Ymf(j)Sf1(j) \quad (8)$$

$$RI2(n) = Kr2 \cdot \sum_{j=n-h}^{n} Ymf(j)Sf2(j) \quad (9)$$

In the above Equations (8) and (9), Kr1 and Kr2 represent response gain correction coefficients, which correct the influence of the damping characteristics of gains due to the high-pass filters 49 and 50, and makes the two values Ymf·Sf1 and Ymf·Sf2 equal in gain.

As described above, in the onboard model analyzer 40, the sum of items of the time-series data of the value Ymf·Sf1 obtained by multiplying the filtered value of the imaginary controlled variable by the filtered value of the first periodic signal value, and the sum of items of the time-series data of the value Ymf·Sf2 obtained by multiplying the filtered value of the imaginary controlled variable by the filtered value of the second periodic signal value, are multiplied by the respective response gain correction coefficients Kr1 and Kr2, whereby the first and second response indices RI1 and RI2 are calculated. Therefore, the values RI1 and RI2 are calculated as values close to a cross-correlation function between the first periodic signal value S1 and the imaginary controlled variable Ym, and a cross-correlation function between the second periodic signal value S2 and the imaginary controlled variable Ym, respectively. That is, the first response index RI1 is calculated as a value indicative of a correlation between the first periodic signal value S1 and the imaginary controlled variable Ym, and the second response index RI2 is calculated as a value indicative of a correlation between the second periodic signal value S2 and the imaginary controlled variable Ym.

Now, as described hereinafter, the repetition period ΔTk at which the intake opening angle θlin included in the first imaginary control input V1 is calculated is considerably longer than the repetition period ΔTn at which the first response index RI1 is calculated, so that the first response index RI1 is by far larger in the degree of reflection on the imaginary controlled variable Ym, and the intake opening angle θlin becomes a steady component, which is hardly reflected on the imaginary controlled variable Ym. Accordingly, the first response index RI1 is calculated as a value indicative of a correlation between the intake opening angle θlin and the indicated mean effective pressure Pmi. More specifically, the absolute value of the first response index RI1 becomes larger as the above correlation is higher, and becomes closer to 0 as the correlation is lower. Further, when the correlation between the intake opening angle θlin and the indicated mean effective pressure Pmi changes from one of a positive one and a negative one to the other, the sign of the first response index RI1 is inverted.

Further, as described hereinafter, the repetition period ΔTk at which the exhaust reopening angle θrbl included in the second imaginary control input V2 is calculated is also considerably longer than the repetition period ΔTn at which the first response index RI1 is calculated, so that for the same reason as described hereinabove, the second response index RI2 is calculated as a value indicative of the correlation between the exhaust reopening angle θrbl and the indicated mean effective pressure Pmi. More specifically, as the correlation between the exhaust reopening angle θrbl and the indicated mean effective pressure Pmi is higher, the absolute value of the second response index RI2 becomes larger, and as the correlation is lower, the absolute value thereof becomes closer to 0. Further, when the correlation between the exhaust reopening angle θrbl and the indicated mean effective pressure Pmi changes from one of a positive one and a negative one to the other, the sign of the second response index RI2 is inverted.

Furthermore, the reason for using the respective filtered values Sf1 and Sf2 of the first and second periodic signal values, and the filtered value Ymf of the imaginary controlled variable is as follows: As described hereinbefore, the repetition period ΔTk at which the intake opening angle θlin included in the first imaginary control input V1 is calculated is considerably longer than the repetition period ΔTn at which the first response index RI1 is calculated, and the intake opening angle θlin becomes a steady component, which can cause an error in the calculation of the first response index RI1. Therefore, to eliminate the intake opening angle θlin as a steady component from the imaginary controlled variable Ym, the imaginary controlled variable Ym is subjected to a high-pass filtering process to use the value Ymf obtained thereby, and to make the first periodic signal value S1 in phase with the value Ymf, the first periodic signal value S1 is subjected to the same high-pass filtering process to use the value Sf1 obtained thereby. Similarly, to eliminate the exhaust reopening angle θrbl as a steady component from the imaginary controlled variable Ym, the imaginary controlled variable Ym is subjected to a high-pass filtering process to use the value Ymf obtained thereby, and to make the second periodic signal in phase with the value Ymf, the second periodic signal value S2 is subjected to the same high-pass filtering process to use the value Sf2 obtained thereby. Further, to make the first response index RI1 and the second response index RI2 equal in gain, the response gain correction coefficients Kr1 and Kr2 are used.

Figure 10:
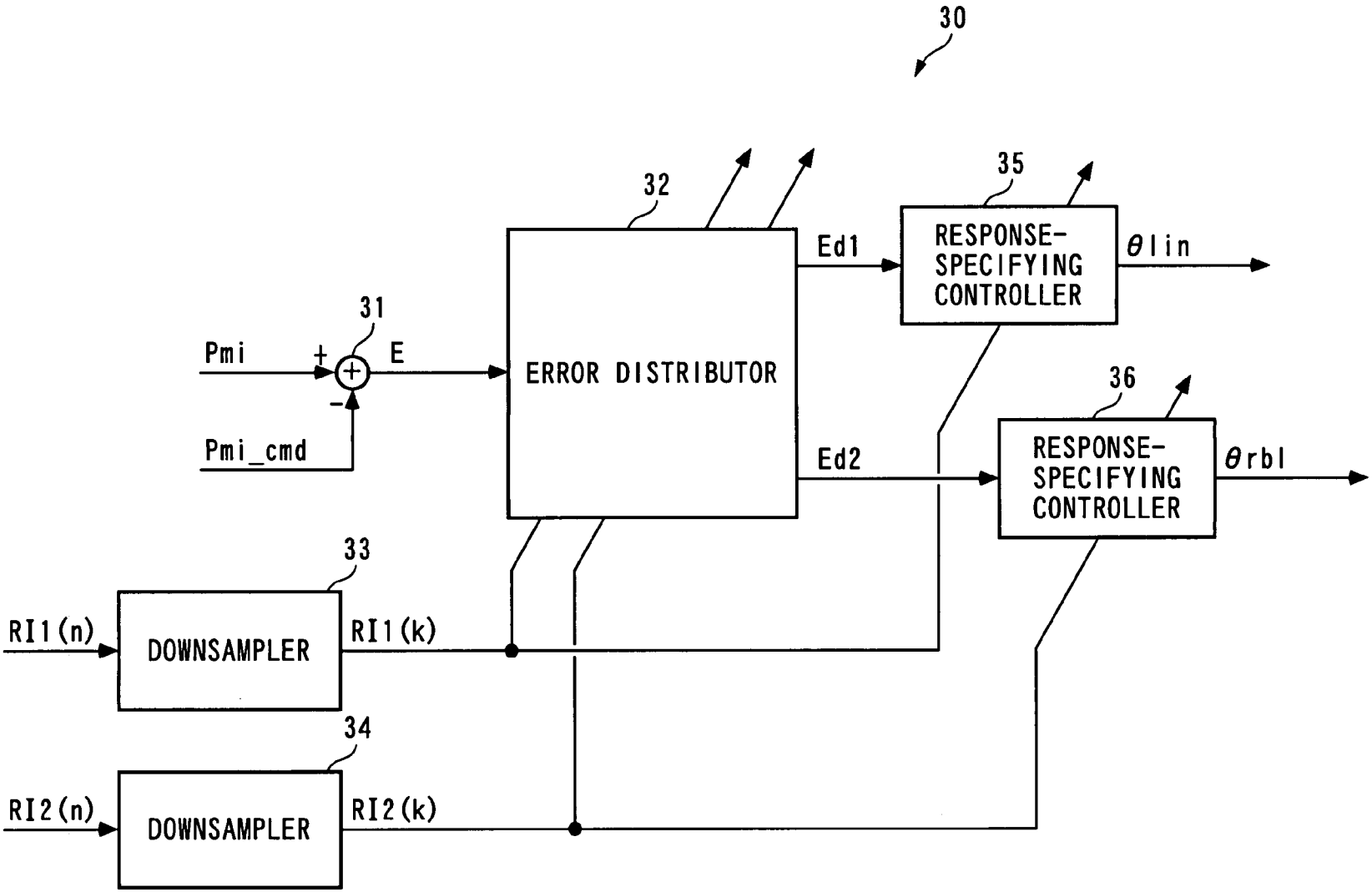
FIG. 10 is a schematic functional block diagram of a cooperative controller.

Next, a description will be given of the aforementioned cooperative controller 30. Referring to FIG. 10, the cooperative controller 30 is comprised of a subtractor 31, an error distributor 32, two downsamplers 33 and 34, and two response-specifying controllers 35 and 36.

It should be noted that in Equations (10) to (18) described hereinafter, discrete data with a symbol (k) indicates that it is data sampled or calculated at a predetermined control period ΔTk (at a repetition period in synchronism with generation of each TDC signal pulse, i.e. whenever the crankshaft rotates through 180°), and the symbol k indicates a position in the sequence of sampling or calculating cycles of respective discrete data. Further, in the following description, the symbol (k) and the like provided for the discrete data are omitted as deemed appropriate.

The cooperative controller 30 calculates a follow-up error E using the subtractor 31 by the following Equation (10):

$$E(k)=Pmi(k)-Pmi_cmd(k) \quad (10)$$

The downsamplers 33 and 34 downsample the first and second response indices RI1(*n*) and RI2(*n*) calculated at the above-described control period ΔTn by the onboard model analyzer 40, at the control period ΔTk, to thereby calculate respective downsampled values RI1(*k*) and RI2(*k*) of the first and second response indices.

Then, the error distributor 32 calculates first and second distributed errors Ed1 and Ed2 using the following Equations (11) and (12), respectively:

$$Ed1(k) = \frac{|RI1(k)|}{|RI1(k)| + |RI2(k)|} \cdot E(k) \tag{11}$$

$$Ed2(k) = \frac{|RI2(k)|}{|RI1(k)| + |RI2(k)|} \cdot E(k) \tag{12}$$

As shown in the Equations (11) and (12), the first and second distributed errors Ed1 and Ed2 are calculated as values obtained by distribution of the follow-up error E according to the ratio of the absolute value |RI1| of the first response index and the absolute value |RI2| of the second response index. It should be noted that in a control process described hereinafter, the value of |RI1| is limited to a predetermined value (e.g. 0.1) close to 0 by a lower limit process so as to avoid the first distributed error Ed1 from becoming equal to 0 (Ed1=0) when RI1=0 holds. Similarly, the value of |RI2| as well is limited to a predetermined value (e.g. 0.1) close to 0 by the lower limit process so as to avoid the second distributed error Ed2 from becoming equal to 0 when RI2=0 holds.

Further, the response-specifying controller 35 calculates the intake opening angle θlin based on the first distributed error Ed1 and the first response index RI1 with a response-specifying control algorithm expressed by the following Equations (13) to (17). That is, the intake opening angle θlin is calculated as a value which causes the first distributed error Ed1 to converge to 0.

$$\theta lin(k) = U1(k) = Urch1(k) + Uadp1(k) \tag{13}$$

$$Urch1(k) = -Krch1 \cdot \sigma 1(k) \tag{14}$$

$$Uadp1(k) = -Kadp1 \cdot \sum_{j=0}^{k} \sigma 1(j) \tag{15}$$

$$\sigma 1(k) = Em1(k) + S \cdot Em1(k-1) \tag{16}$$

$$Em1(k) = \frac{RI1(k)}{\text{RI1_max}} \cdot Ed1(k) \tag{17}$$

In the above Equation (13), Urch1 represents a reaching law input, and is calculated using the Equation (14). In the Equation (14), Krch1 represents a predetermined reaching law gain, and σ1 represents a switching function calculated by the Equation (16). In the Equation (16), S represents a switching function-setting parameter set such that −1<S<0 holds, and Em1 represents a first follow-up error calculated by the Equation (17). In the Equation (17), RI1_max represents the maximum value which the absolute value |RI1| of the first response index can assume during the control, and a value set in advance in offline is used as RI1_max. Further, in the Equation (13), Uadp1 represents an adaptive law input, and is calculated by the Equation (15). In the Equation (15), Kadp1 represents a predetermined adaptive law gain.

On the other hand, the response-specifying controller 36 calculates the exhaust reopening angle θrbl based on the second distributed error Ed2 and the second response index RI2 with a response-specifying control algorithm expressed by the following Equations (18) to (22). That is, the exhaust reopening angle θrbl is calculated as a value which causes the second distributed error Ed2 to converge to 0.

$$\theta rb1(k) = U2(k) = Urch2(k) + Uadp2(k) \tag{18}$$

$$Urch2(k) = -Krch2 \cdot \sigma 2(k) \tag{19}$$

$$Uadp2(k) = -Kadp2 \cdot \sum_{j=0}^{k} \sigma 2(j) \tag{20}$$

$$\sigma 2(k) = Em2(k) + S \cdot Em2(k-1) \tag{21}$$

$$Em2(k) = \frac{RI2(k)}{\text{RI2_max}} \cdot Ed2(k) \tag{22}$$

In the above Equation (18), Urch2 represents a reaching law input, and is calculated by the Equation (19). In the Equation (19), Krch2 represents a predetermined reaching law gain, and σ2 represents a switching function calculated by the Equation (21). In the Equation (21), Em2 represents a second follow-up error calculated by the Equation (22). In the Equation (22), RI2_max represents the maximum value which the absolute value |RI2| of the second response index can assume during the control, and a value set in advance in offline is used as RI2_max. Further, in the Equation (18), Uadp2 represents an adaptive law input, and is calculated by the Equation (20). In the Equation (20), Kadp2 represents a predetermined adaptive law gain.

As described above, the cooperative controller 30 calculates the intake opening angle θlin such that the intake opening angle θlin causes the first distributed error Ed1 to converge to 0, and the exhaust reopening angle θrbl such that the exhaust reopening angle θrbl causes the second distributed error Ed2 to converge to 0, with the respective response-specifying control algorithms. As a result, the intake opening angle θlin and the exhaust reopening angle θrbl are calculated such that they cause the follow-up error E to converge to 0, in other words, such that they cause the indicated mean effective pressure Pmi to converge to its target value Pmi_cmd.

At this time, the first and second follow-up errors Em1 and Em2 used in the response-specifying control algorithms are calculated by multiplying the first and second distributed errors Ed1 and Ed2 by the values RI1/RI1_max and RI2/RI2_max, respectively, as shown in the Equations (17) and (22), so that as the first response index RI1 becomes closer to its maximum value RI1_max, i.e. as the correlation between the intake opening angle θlin and the indicated mean effective pressure Pmi becomes higher, the increasing/decreasing rate of the intake opening angle θlin as a control input become larger. Similarly, as the second response index RI2 becomes closer to its maximum value RI2_max, i.e. as the correlation between the exhaust reopening angle θrbl and the indicated mean effective pressure Pmi becomes higher, the increasing/decreasing rate of the exhaust reopening angle θrbl as a control input become larger. As described above, even when the sensitivity, i.e. the correlation of the indicated mean effective pressure Pmi as a controlled variable associated with the intake opening angle θlin and the exhaust reopening angle θrbl as control inputs changes according to the values of the control inputs θlin and θrbl, it is possible to determine the increasing/decreasing rates of the control inputs θlin and θrbl according to the change in the correlation, thereby making it possible to control the controlled variable Pmi such that the controlled variable Pmi converges to its target value Pmi_cmd without causing any oscillating behavior or unstable behavior. That is, it is possible to ensure high-level stability of the control.

Further, the first and second follow-up errors Em1 and Em2 are calculated using the aforementioned Equations (17) and (22), respectively, and hence when the signs of the first and second response indices RI1 and RI2 are inverted, the signs of the follow-up errors Em1 and Em2 are also inverted, whereby the increasing/decreasing directions of the intake opening angle θlin and the exhaust reopening angle θrbl as control inputs are inverted. More specifically, the increasing/decreasing directions are each inverted from an increasing one to a decreasing one, or from the decreasing one to the increasing one.

In this case, as described hereinabove, the first response index RI1 represents the correlation between the intake opening angle θlin and the indicated mean effective pressure Pmi, and when the correlation therebetween changes from one of the positive and negative correlations to the other, the sign of the first response index RI1 is inverted. Therefore, by inverting the increasing/decreasing direction of the intake opening angle θlin according to the change in the correlation, e.g. even when the indicated mean effective pressure Pmi happens to assume its maximum value along with the change in the intake opening angle θlin, and at the same time the target value Pmi_cmd of the indicated mean effective pressure is set to a value larger than its maximum value, it is possible to hold the indicated mean effective pressure Pmi close to its maximum value.

Similarly, the second response index RI2 represents the correlation between the exhaust reopening angle θrbl and the indicated mean effective pressure Pmi, and when the correlation therebetween changes from one of the positive and negative correlations to the other, the sign of the second response index RI2 is inverted. Therefore, by inverting the increasing/decreasing direction of the exhaust reopening angle θrbl according to the change in the correlation, as described hereinabove, when the indicated mean effective pressure Pmi is in a region where it takes its maximum value in response to the change in the exhaust reopening angle θrbl, even when the target value Pmi_cmd of the indicated mean effective pressure is set to a value larger than its maximum value, it is possible to hold the indicated mean effective pressure Pmi close to its maximum value.

Further, the first and second distributed errors Ed1 and Ed2 are calculated as values obtained by distribution of the follow-up error E according to the ratio of the absolute value |RI1| of the first response index and the absolute value |RI2| of the second response index, and the intake opening angle θlin and the exhaust reopening angle θrbl are calculated such that they cause the first distributed error Ed1 and the second distributed error Ed2 to converge to 0, respectively. Accordingly, one of the intake opening angle θlin and the exhaust reopening angle θrbl associated with the larger one of the aforementioned ratios of the absolute values, i.e. one having a higher correlation with the indicated mean effective pressure Pmi, is set to a larger increasing/decreasing rate. As described above, one of the intake opening angle θlin and the exhaust reopening angle θrbl, which has a higher correlation with the indicated mean effective pressure Pmi, is set a larger increasing/decreasing rate, and the other, which has a lower correlation with the indicated mean effective pressure Pmi, is set to a smaller increasing/decreasing rate. This makes it possible to cause the indicated mean effective pressure Pmi to accurately converge to its target value Pmi_cmd while avoiding a mutual interaction between the intake opening angle θlin and the exhaust reopening angle θrbl.

Figure 11:
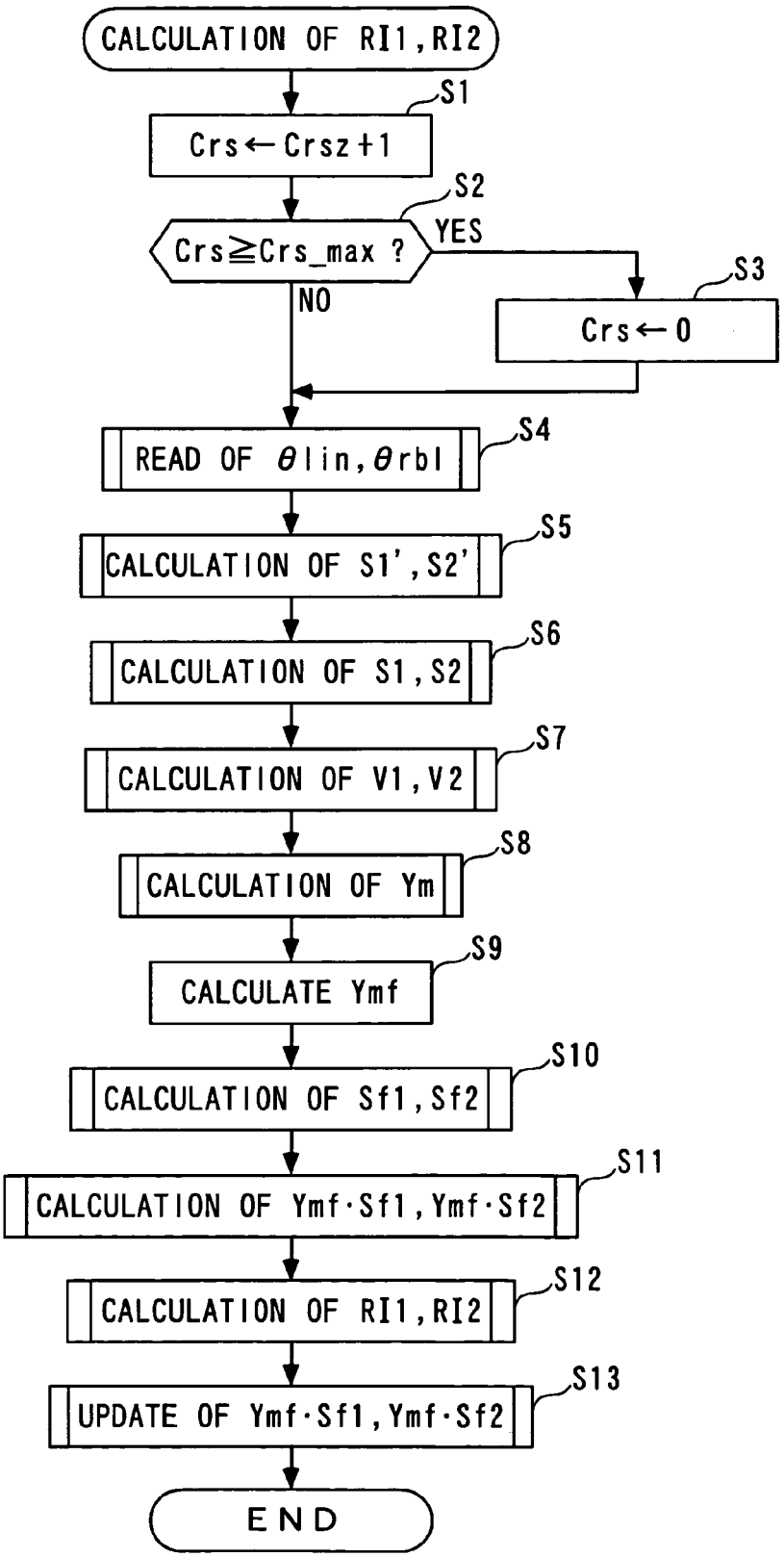
FIG. 11 is a flowchart of a process for calculating first and second response indices RI1 and RI2.

Next, a process for calculating the first and second response indices RI1 and RI2 executed by the ECU 2 will be described with reference to FIG. 11. This process corresponds to the calculation process by the onboard model analyzer 40, and is performed at the control period ΔTn.

In the process, first, in a step 1 (shown as S1 in abbreviated form in FIG. 11; the following steps are also shown in abbreviated form), the counter value Crs is set to a value (Crsz+1) obtained by adding 1 to the immediately preceding value Crsz thereof. That is, the counter value Crs is incremented by 1.

Then, the process proceeds to a step 2, wherein it is determined whether or not the counter value Crs calculated in the step 1 is not smaller than the maximum value Crs_max. If the answer to this question is negative (NO), the process immediately proceeds to a step 4. On the other hand, if the answer to this question is affirmative (YES), the counter value Crs is reset to 0 in a step 3, followed by the process proceeding to the step 4.

In the step 4 following the step 2 or 3, values of the intake opening angle θlin and the exhaust reopening angle θrbl stored in the RAM are read in. In this case, although the intake opening angle θlin and the exhaust reopening angle θrbl are calculated at the aforementioned control period ΔTk, the step 4 is executed at the control period ΔTn shorter than the control period ΔTk. Therefore, the process executed in the step 4 corresponds to calculation of the respective oversampled values θlin(n) and θrbl(n) of the intake opening angle θlin and the exhaust reopening angle θrbl.

Then, the process proceeds to a step 5, wherein the basic values S1' and S2' of the first and second periodic signal values are calculated by searching the map shown in FIG. 9, according to the counter value Crs.

After that, in a step 6, the first and second periodic signal values S1 and S2 are calculated using the aforementioned Equations (1) and (2), respectively. Then, in a step 7, the first and second imaginary control inputs V1 and V2 are calculated using the aforementioned Equations (3) and (4), respectively.

Then, the process proceeds to a step 8, wherein the imaginary controlled variable Ym is calculated. More specifically, as described hereinbefore, in place of the FIG. 6 controlled object model, the controlled object model is used in which the intake opening angle θlin is replaced by the first imaginary control input V1, and the three predetermined values θrbl1 to θrbl3 of the exhaust reopening angle θrbl are replaced by the three predetermined values V2_1 to V2_3 of the second imaginary control input V2, and to this controlled object model is applied the first and second imaginary control inputs V1 and V2 calculated as above, whereby the imaginary controlled variable Ym is calculated.

Subsequently, in a step 9, the filtered value Ymf of the imaginary controlled variable is calculated by the aforementioned Equation (5), whereafter in a step 10, the filtered values Sf1 and Sf2 of the first and second periodic signal values are calculated using the aforementioned Equations (6) and (7), respectively.

Then, the process proceeds to a step 11, wherein the two multiplied values Ymf·Sf1 and Ymf·Sf2 are calculated by multiplying the filtered value Ymf of the imaginary controlled variable, calculated in the step 9, by the respective filtered values Sf1 and Sf2 of the first and second periodic signal values, calculated in the step 10.

After that, in a step 12, the first and second response indices RI1 and RI2 are calculated using the two multiplied values Ymf·Sf1 and Ymf·Sf2 calculated in the step 11, and time-series data of h Ymf·Sf1 and Ymf·Sf2 which were calculated in the immediately preceding and further preceding loops are stored in the RAM, by the aforementioned Equations (8) and (9), respectively.

Figure 12:
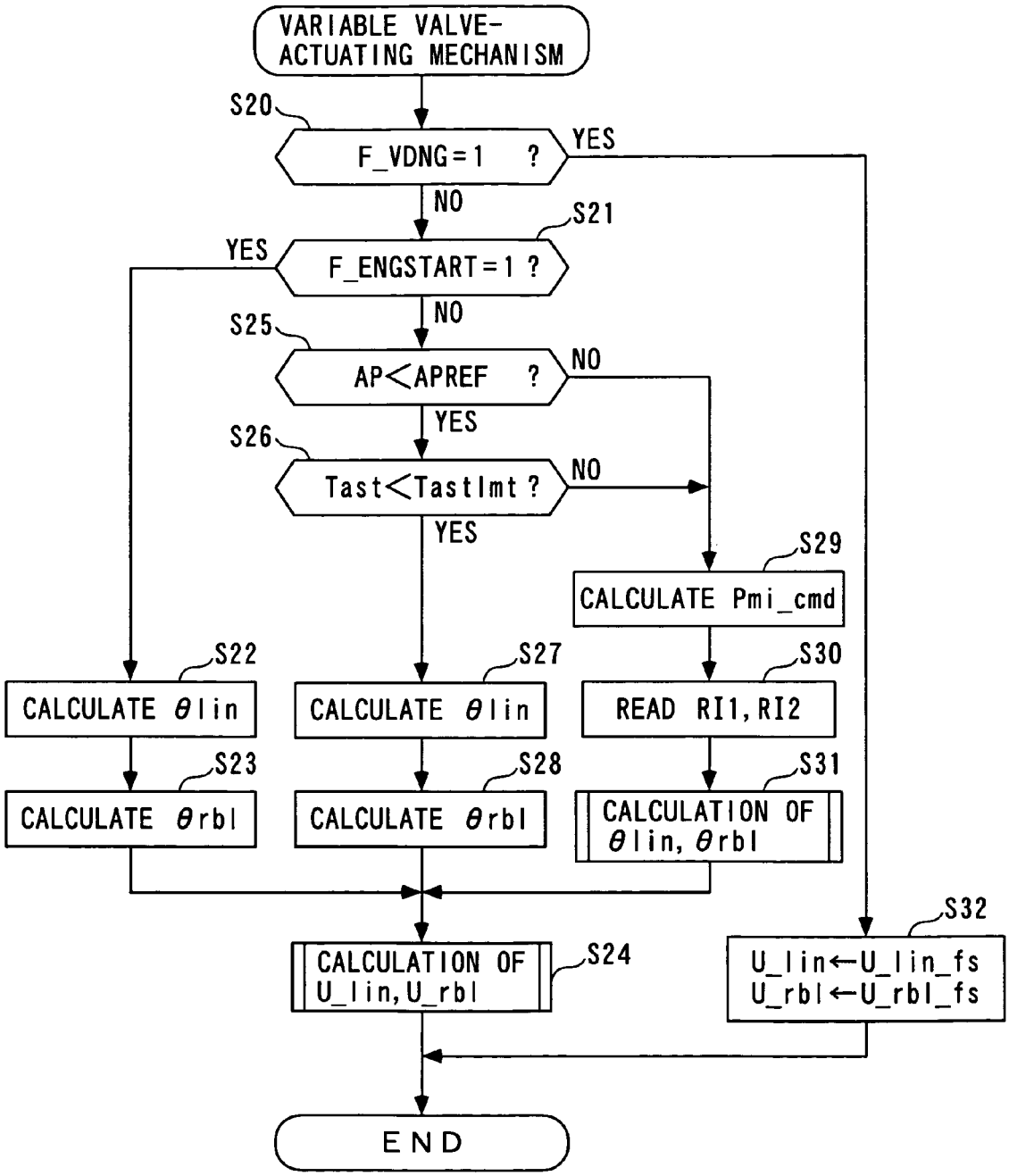
FIG. 12 is a flowchart of a control process for controlling the variable valve-actuating mechanisms.

Then, the process proceeds to a step 13, wherein the time-series data of the h Ymf·Sf1 and Ymf·Sf2 stored in the RAM are updated. More specifically, each value of the Ymf·Sf1 and Ymf·Sf2 in the RAM is set to the immediately preceding value thereof which is a value preceding by one control cycle (for example, the current value Ymf·Sf1($n$) is set to the immediately preceding value Ymf·Sf1($n-1$), and the immediately preceding value Ymf·Sf1($n-1$) is set to the second preceding value Ymf·Sf1($n-2$)), followed by terminating the present process Hereinafter, the control process of the variable valve-actuating mechanisms, which is carried out by the ECU 2 at the aforementioned control period ΔTk, will be described with reference to FIG. 12. The control process controls the variable intake valve-actuating mechanism 4 and the variable exhaust valve-actuating mechanism 5, respectively, and includes steps corresponding to the calculation process performed by the cooperative controller 30.

In this control process, first, in a step 20, it is determined whether or not a variable mechanism failure flag F_VDNG is equal to 1. More specifically, the variable mechanism failure flag F_VDNG is set to 1 when it is determined that at least one of the variable mechanisms 4 and 5 is faulty, and to 0 when it is determined that the variable mechanisms 4 and 5 are both normal. If the answer to the above question is negative (NO), i.e. if the two variable mechanisms are both normal, the process proceeds to a step 21, wherein it is determined whether or not an engine start flag F_ENGSTART is equal to 1.

The above engine start flag F_ENGSTART is set by determining in a determination process, not shown, whether or not engine start control is being executed, i.e. the engine 3 is being cranked, based on the engine speed NE and the ON/OFF signal output from the IG·SW 26. More specifically, when the engine start control is being executed, the engine start flag F_ENGSTART is set to 1, and otherwise set to 0.

Figure 13:
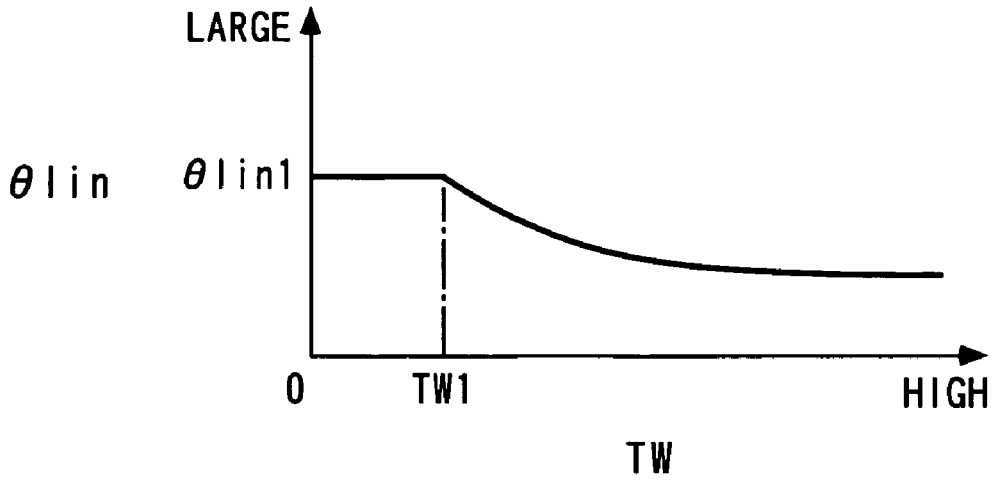
FIG. 13 is a view of an example of a map for use in calculation of an intake opening angle θlin during execution of engine start control.

If the answer to the question of the step 21 is affirmative (YES), i.e. if the engine start control is being executed, the process proceeds to a step 22, wherein the intake opening angle θlin is calculated by searching a map shown in FIG. 13, according to the engine coolant temperature TW.

In this map, in the range where the engine coolant temperature TW is higher than a predetermined value TW1, the intake opening angle θlin is set to a larger value as the engine coolant temperature TW is lower, and in the range where TW≦TW1 holds, the intake opening angle θlin is set to a predetermined value θlin1. This is to compensate for an increase in friction of the engine 3, which is caused when the engine coolant temperature TW is low.

Figure 14:
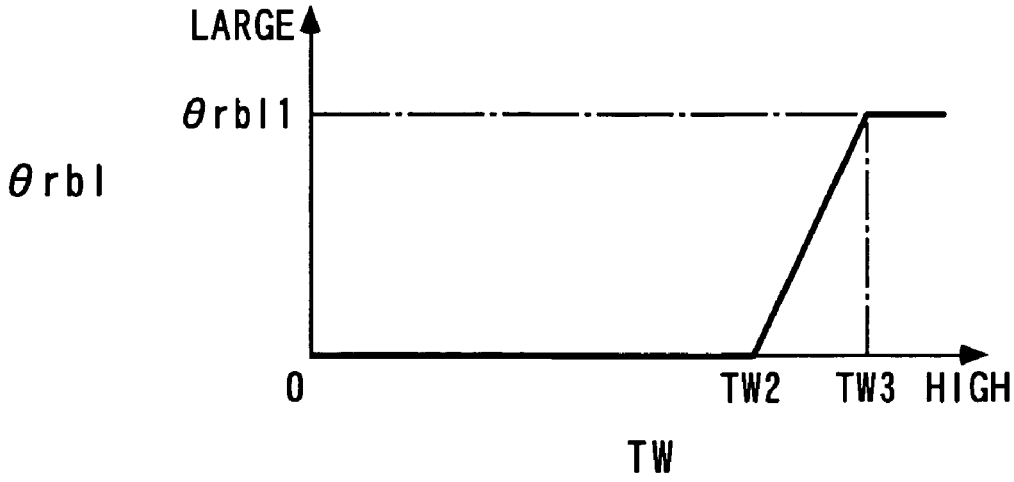
FIG. 14 is a view of an example of a map for use in calculation of an exhaust reopening angle θrbl during execution of the engine start control.

Then, the process proceeds to a step 23, wherein the exhaust reopening angle θrbl is calculated by searching a map shown in FIG. 14, according to the engine coolant temperature TW. In FIG. 4, TW2 and TW3 represent predetermined values of the engine coolant temperature TW which satisfy the relationship of TW2<TW3.

In this map, the exhaust reopening angle θrbl is set to 0 in the range where TW<TW2 holds, and in the range where TW2≦TW≦TW3 holds, the exhaust reopening angle θrbl is set to a larger value as the engine coolant temperature TW is lower, while in the range where TW3<TW holds, the exhaust reopening angle θrbl is set to the predetermined value θrbl1. This is to reopen the exhaust valve 5*a* during the intake stroke so as to start the engine 3 in the compression ignition combustion for enhancement of exhaust emission, when the engine 3 is restarted in a state where the engine coolant temperature TW is high.

Then, the process proceeds to a step 24, wherein a control input U_lin to the intake solenoid 4*b* is calculated based on the intake opening angle θlin calculated in the step 22, and a control input U_rbl to the exhaust solenoid 5*b* is calculated based on the exhaust reopening angle θrbl calculated in the step 23. Thus causes the intake valve 4*a* to open to the intake opening angle θlin, and the exhaust valve 5*a* to reopen to the exhaust reopening angle θrbl during the intake stroke as well, followed by terminating the present process.

On the other hand, if the answer to the question of the step 21 is negative (NO), i.e. if the engine start control is not being executed, the process proceeds to a step 25, wherein it is determined whether or not the accelerator pedal opening AP is smaller than a predetermined value APREF. With reference to the predetermined value APREF, it is determined whether the accelerator pedal is not stepped on, and is set to a value (e.g. 1°) so as to enable determination that the accelerator pedal is not stepped on.

If the answer to this question is affirmative (YES), i.e. if the accelerator pedal is not stepped on, the process proceeds to a step 26, wherein it is determined whether or not the count Tast of an after-start timer is smaller than a predetermined value Tastlmt. The after-start timer counts time elapsed after the termination of the engine start control, and is implemented by an up-count timer.

Figure 15:
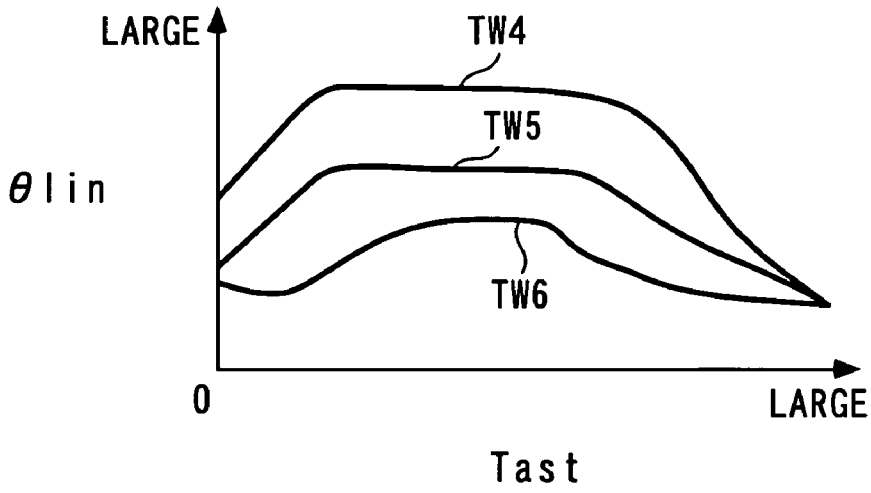
FIG. 15 is a view of an example of a map for use in calculation of the intake opening angle θlin during execution of catalyst warmup control.

If the answer to this question is affirmative (YES), i.e. if Tast<Tastlmt holds, it is judged that the catalyst warmup control should be executed, and the process proceeds to a step 27, wherein the intake opening angle θlin is calculated by searching a map shown in FIG. 15, according to the count Tast of the after-start timer for the catalyst warmup control and the engine coolant temperature TW. In FIG. 15, TW4 to TW6 represent predetermined values of the engine coolant temperature TW, which satisfy the relationship of TW4<TW5<TW6.

In this map, the intake opening angle θlin is set to a larger value as the engine coolant temperature TW is lower. This is because as the engine coolant temperature TW is lower, it takes a longer time period to activate the catalyst, and hence the volume of exhaust gasses is increased to shorten the time period required for activation of the catalyst.

Figure 16:
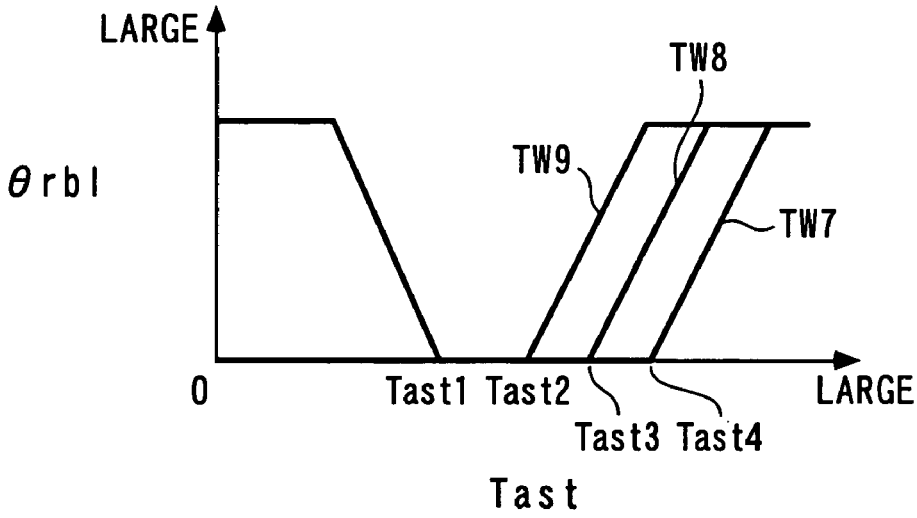
FIG. 16 is a view of an example of a map for use in calculation of the exhaust reopening angle θrbl during execution of the catalyst warmup control.

Next, in a step 28, the exhaust reopening angle θrbl is calculated by searching a map shown in FIG. 16, according to the count Tast of the after-start timer and the engine coolant temperature TW. In FIG. 16, TW7 to TW9 represent predetermined values of the engine coolant temperature TW, which satisfy the relationship of TW7<TW8<TW9, and Tast1 to Tast4 represent predetermined values of the count Tast of the after-start timer, which satisfy the relationship of Tast1<Tast2<Tast3<Tast4.

In this map, the exhaust reopening angle θrbl is set to 0 when the count Tast of the after-start timer is within a predetermined range (between Tast1 and Tast2, between Tast1 and Tast3, or between Tast1 and Tast4), whereas when the count Tast exceeds the predetermined range, the exhaust reopening angle θrbl is set to a larger value as the count Tast is larger. This is for the following reason: During the compression ignition combustion operation, combustion efficiency becomes higher than during the spark ignition combustion operation, and the heat energy of exhaust gases is lower. Therefore, the engine 3 is operated in the spark ignition combustion at the start of the catalyst warmup control, and hence the valve-reopening operation for reopening the exhaust valve 5*a* during the intake stroke is stopped, and in accordance with the progress of the catalyst warmup control, the reopening operation is restarted during the intake stroke so as to restore the engine 3 from the spark ignition combustion operation to the compression ignition combustion operation. Further, the range where the exhaust reopening angle θrbl is set to 0 is set to be larger as the engine coolant temperature TW is lower. This is because as the engine coolant temperature TW is lower, the temperature of exhaust gases becomes lower, whereby it takes a longer time period to warm up the catalyst.

Then, the step 24 is carried out as described above, followed by terminating the present process.

Figure 17:
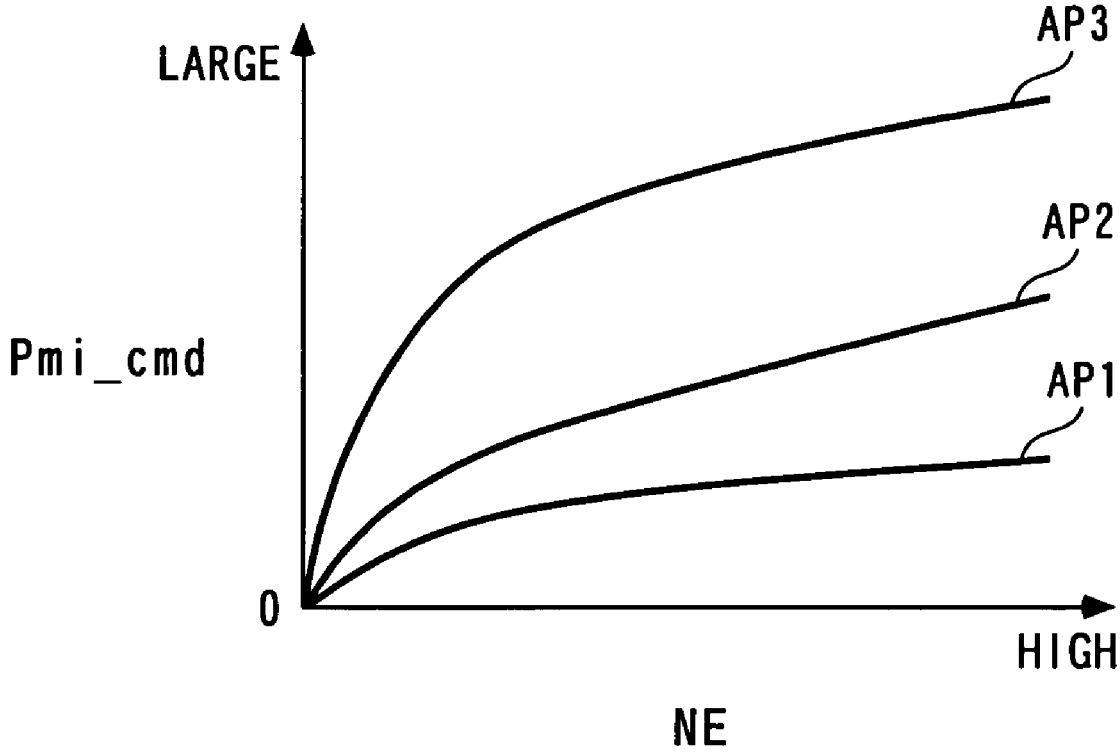
FIG. 17 is a view of an example of a map for use in calculation of a target value Pmi_cmd of the indicated mean effective pressure during execution of normal control.

On the other hand, if the answer to the question of the step 25 or 26 is negative (NO), i.e. if the accelerator pedal is stepped on, or if Tast≧Tastlmt holds, the process proceeds to a step 29, wherein the target value Pmi_cmd of the indicated mean effective pressure is calculated by searching a map shown in FIG. 17, according to the engine speed NE and the accelerator pedal opening AP. In FIG. 17, AP1 to AP3 represent predetermined values of the accelerator pedal opening AP, which satisfy the relationship of AP1<AP2<AP3.

In this map, the target value Pmi_cmd of the indicated mean effective pressure is set to a larger value as the engine speed NE is higher or as the accelerator pedal opening AP is larger. This is because as the engine speed NE is higher or the accelerator pedal opening AP is larger, a larger torque of the engine 3 is demanded.

Then, the process proceeds to a step 30, wherein the values of the first and second response indices RI1 and RI2, stored in the RAM, are read in. In this case, as described hereinbefore, the first and second response indices RI1 and RI2 are calculated at the control period ΔTn shorter than the control period ΔTk of the present process, so that the process performed in the step 30 corresponds to calculation of the downsampled values RI1(*k*) and RI2(*k*) of the first and second response indices RI1 and RI2.

In a step 31 following the step 30, the intake opening angle θlin is calculated using the aforementioned Equations (10), (11), and (13) to (17), and the exhaust reopening angle θrbl is calculated using the aforementioned Equations (10), (12), and (18) to (22). In doing this, to avoid the first distributed error Ed1 from becoming equal to 0 when RI1=0 holds, the value of |RI2| in the Equation (11) is limited to a predetermined value (e.g. 0.1) close to 0 by lower limit processing. Similarly, the value of |RI2| in the Equation (12) is also limited to a predetermined value (e.g. 0.1) close to 0 by lower limit processing so as to avoid the second distributed error Ed2 from becoming equal to 0 when RI2=0 holds. Then, the step 24 is executed, as described above, followed by terminating the present process.

On the other hand, if the answer to the question of the step 20 is affirmative (YES), i.e. if at least one of the two variable valve-actuating mechanisms 4 and 5 is faulty, the process proceeds to a step 32, wherein the control inputs U_lin and U_rbl to the intake solenoid 4*b* and the exhaust solenoid 5*b* are set to predetermined failure-time values U_lin_fs and U_rbl_fs, respectively, followed by terminating the present process. This causes idling or starting of the engine 3 to be appropriately performed during stoppage of the vehicle, and a low-speed traveling condition to be maintained during travel of the vehicle.

Figure 18:
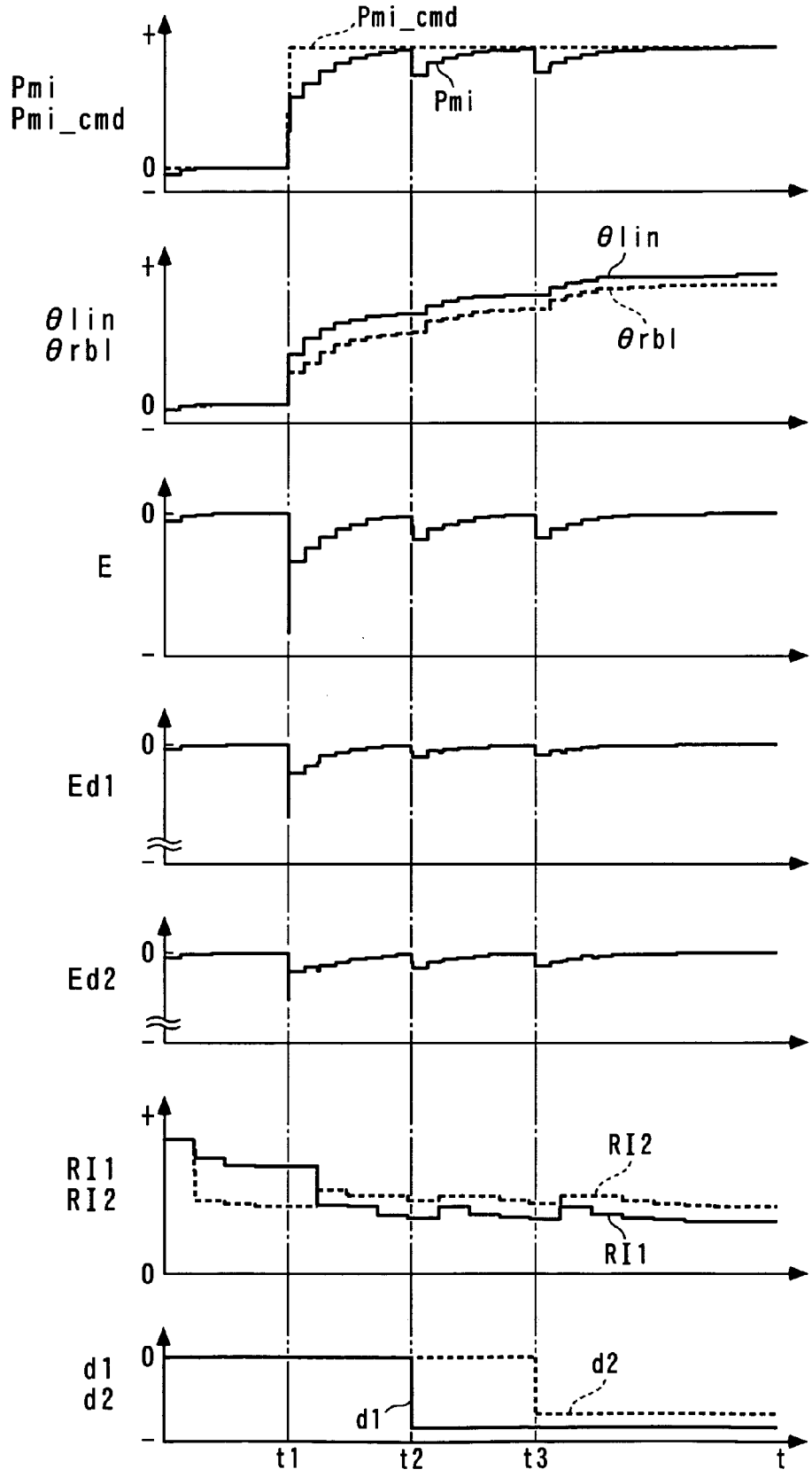
FIG. 18 is a timing diagram showing an example of results of a simulation of control of the indicated mean effective pressure Pmi, executed by the control apparatus.

Next, a description will be given of results (hereinafter referred to as "the control results") of simulations of controlling the indicated mean effective pressure Pmi by the control apparatus 1 according to the present embodiment configured as described above. FIG. 18 shows an example of the control results obtained by the control apparatus 1, in which disturbances d1 and d2 are intentionally applied during the control, whereas FIG. 19 shows an example of the control results obtained by the control apparatus 1, in which for comparison with the FIG. 18 control results, the exhaust reopening angle θrbl is held at 0 to control the indicated mean effective pressure Pmi only by the intake opening angle θlin, and the disturbances d1 and d2 are intentionally applied during the control.

First, from the FIG. 18 example of the control results, it is known that immediately after the target value Pmi_cmd of the indicated mean effective pressure is changed by a step at time t1, the follow-up error E is temporarily and sharply increased to temporarily increase the first and the second distributed errors Ed1 and Ed2, respectively, but the follow-up error E is controlled such that it converges to 0 with the lapse of time. That is, it is known that the follow-up property of the indicated mean effective pressure Pmi to the target value Pmi_cmd is ensured at a high level.

Further, it is known that immediately after the disturbance d1 is applied at time t2, the follow-up error E is temporarily increased to temporarily increase the first and the second distributed errors Ed1 and Ed2, respectively, but the follow-up error E is controlled such that it converges to 0 with the lapse of time. Similarly, it is known that also when the disturbance d2 is applied at time t3, the follow-up error E is temporarily increased to temporarily increase the first and the second distributed errors Ed1 and Ed2, respectively, but the follow-up error E is controlled such that it converges to 0 with the lapse of time. That is, it is known that high-level robustness is ensured.

Figure 19:
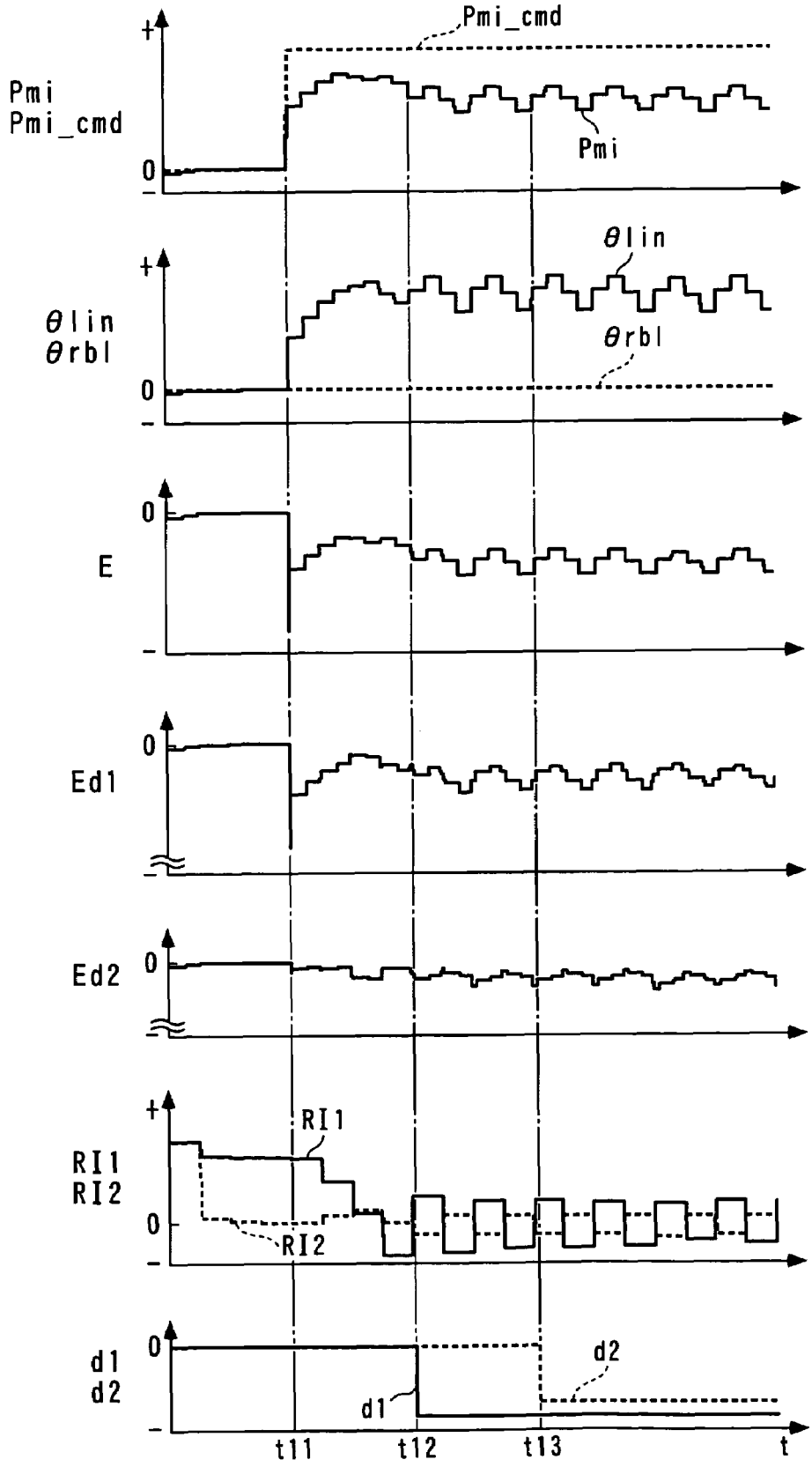
FIG. 19 is a timing diagram showing an example of results of a simulation of control in which the exhaust reopening angle θrbl is held at a value of 0, and the indicated mean effective pressure Pmi is controlled only by the intake opening angle θlin.

In contrast, from the FIG. 19 example of the control results, it is known that immediately after the target value Pmi_cmd of the indicated mean effective pressure is changed by a step at time t11, the follow-up error E is temporarily and sharply increased to temporarily increase the first and the second distributed errors Ed1 and Ed2, respectively, whereafter the follow-up error E does not converge to 0 in spite of the lapse of time. That is, it is known that the indicated mean effective pressure Pmi does not reach its target value Pmi_cmd. This is because when the exhaust reopening angle θrbl is held at 0 to control the indicated mean effective pressure Pmi only by the intake opening angle θlin, an attainable value of the indicated mean effective pressure Pmi is limited, and in the FIG. 19 example, the indicated mean effective pressure Pmi is controlled to its limit value.

As described hereinbefore, according to the control apparatus 1 of the present embodiment, the onboard model analyzer 40 calculates the first response index RI1 as a value indicative of the correlation between the intake opening angle θlin and the indicated mean effective pressure Pmi. More specifically, as the correlation therebetween is higher, the absolute value of the first response index RI1 becomes larger, and when the correlation therebetween changes from one of the positive and negative correlations to the other, the sign of the first response index RI1 is inverted. Similarly, the second response index RI2 is calculated as a value indicative of the correlation between the exhaust reopening angle θrbl and the indicated mean effective pressure Pmi. More specifically, as the correlation therebetween is higher, the absolute value of the second response index RI2 becomes larger, and when the correlation therebetween changes from one of the positive and negative correlations to the other, the sign of the second response index RI2 is inverted.

On the other hand, the cooperative controller 30 calculates the intake opening angle θlin and the exhaust reopening angle θrbl with the response-specifying control algorithms such that the indicated mean effective pressure Pmi is caused to converge to its target value Pmi_cmd. At this time, the first and second follow-up errors Em1 and Em2 used in the response-specifying control algorithms are calculated by multiplying the first and second distributed errors Ed1 and Ed2 by the values RI1/RI1_max and RI2/RI2_max, respectively, so that as the first response index RI1 becomes closer to its maximum value RI1_max, i.e. as the correlation between the intake opening angle θlin and the indicated mean effective pressure Pmi becomes higher, the rate of increase/decrease in the intake opening angle θlin as a control input become larger. Similarly, as the second response index RI2 becomes closer to its maximum value RI2_max, i.e. as the correlation between the exhaust reopening angle θrbl and the indicated mean effective pressure Pmi becomes higher, the rate of increase/decrease in the exhaust reopening angle θrbl as a control input become larger. As described above, even when the sensitivity, i.e. the correlation of the indicated mean effective pressure Pmi as a controlled variable to the intake opening angle θlin and the exhaust reopening angle θrbl as control inputs changes according to the values of the control inputs θlin and θrbl, it is possible to determine the increasing/decreasing rates of the control inputs θlin and θrbl according to the changes in the correlation, thereby making it possible to control the controlled variable Pmi such that the controlled variable Pmi converges to its target value Pmi_cmd without causing any oscillating behavior or unstable behavior. That is, it is possible to ensure high-level stability of control.

Further, the first and second follow-up errors Em1 and Em2 are calculated using the aforementioned Equations (17) and (22), respectively, and hence when the signs of the first and second response indices RI1 and RI2 are inverted, the signs of the follow-up errors Em1 and Em2 are also inverted, whereby the increasing/decreasing directions of the intake opening angle θlin and the exhaust reopening angle θrbl as control inputs are inverted. More specifically, each increasing/decreasing direction is inverted from the increasing direction to the decreasing direction, or from the decreasing direction to the increasing direction.

Therefore, as shown in FIG. 6, when the indicated mean effective pressure Pmi is in a region where it takes its maximum value in response to the change in the exhaust reopening angle θrbl, even when the target value Pmi_cmd of the indicated mean effective pressure is set to a value larger than its maximum value, it is possible to hold the indicated mean effective pressure Pmi close to its maximum value. That is, even when the controlled object having the extremal characteristic is controlled, it is possible to ensure both high-level stability and accuracy of control.

Further, the imaginary controlled variable Ym, the two imaginary control inputs V1 and V2, and the two response indices RI1 and RI2 are all calculated at the predetermined control period ΔTn, using the FIG. 6 controlled object model, so that when the controlled variable of the multi-input multi-output system is controlled by a plurality of control inputs, manufacturing costs and computation load can be reduced compared with a control apparatus which executes lots of processes for determining conditions and data processing of a large amount of mapping data during the operation. That is, even when the controlled object of the multi-input multi-output system is controlled, it is possible to reduce the manufacturing costs and computation load thereon.

Further, the first and second distributed errors Ed1 and Ed2 are calculated as values obtained by distribution of the follow-up error E according to the ratio of the absolute value |RI1| of the first response index and the absolute value |RI2| of the second response index, and the intake opening angle θlin and the exhaust reopening angle θrbl are calculated as values which cause the first distributed error Ed1 and the second distributed error Ed2 to converge to 0, respectively. Accordingly, one of the intake opening angle θlin and the exhaust reopening angle θrbl, which has a larger absolute value, i.e. a higher correlation with the indicated mean effective pressure Pmi, is set to be larger in the increasing/decreasing rate. As described above, one of the intake opening angle θlin and the exhaust reopening angle θrbl, which has a higher correlation with the indicated mean effective pressure Pmi, is set to be larger in the increasing/decreasing rate, and the other, which has a lower correlation with the indicated mean effective pressure Pmi, is set to be smaller in the increasing/decreasing rate. This makes it possible to cause the indicated mean effective pressure Pmi to accurately converge to its target value Pmi_cmd while avoiding a mutual interaction between the intake opening angle θlin and the exhaust reopening angle θrbl as control inputs, and causing the two control inputs to cooperate with each other. That is, it is possible to ensure both high-level stability and accuracy of control even when a controlled object of the multi-input multi-output system is controlled.

Further, the first and second response indices RI1 and RI2 are calculated by multiplying the value Ymf obtained by subjecting the imaginary controlled variable Ym to a high-pass filtering process, by the respective values Sf1 and Sf2 obtained by subjecting the first and second periodic signal values S1 and S2 to the same high-pass filtering process, and multiplying the sum of the time-series data of the multiplied values Ymf·Sf1 and Ymf·Sf2 by the respective response gain correction coefficients Kr1 and Kr2. Therefore, it is possible to appropriately calculate the first and second response indices RI1 and RI2 as values which eliminate the intake opening angle θlin and the exhaust reopening angle θrbl as steady components of the imaginary controlled variable Ym, and at the same time cause the gain characteristics and the phase characteristics of the filtered values Sf1 and Sf2 of the periodic signal values to match those of the filtered value Ymf of the imaginary controlled variable. Therefore, e.g. even when the intake opening angle θlin and the exhaust reopening angle θrbl separately largely change with a large change in the target value Pmi_cmd, it is possible to calculate the correlation parameters while avoiding the adverse influence of the changes in the intake opening angle θlin and the exhaust reopening angle θrbl. This makes it possible to further enhance the stability and accuracy of control.

Furthermore, the first and second periodic signal values S1 and S2 have respective repetition periods (crank angles of 45° and 90°) different from each other. Due to the different frequencies of the periodic signal values S1 and S2, which are reflected on the imaginary controlled variable Ym, it is possible to calculate the first and second response indices RI1 and RI2 as values accurately indicative of the respective correlations between the first and second periodic signal values S1 and S2 and the imaginary controlled variable Ym, that is, the correlations between the intake opening angle θlin and the exhaust reopening angle θrbl, and the indicated mean effective pressure Pmi.

Further, the respective repetition periods (crank angles of 45° and 90°) of the first and second periodic signal values S1 and S2 are set to be longer than the repetition period ΔTn (crank angle of 5°) at which the onboard model analyzer 40 calculates the first and second response indices RI1 and RI2, more specifically, integral multiples of 9-hold and 18-hold of the repetition period ΔTn, and further the repetition period ΔTk at which the cooperative controller 30 calculates the intake opening angle θlin and the exhaust reopening angle θrbl is set to an integral multiple (2·ΔT2) of the least common multiple (ΔT2) of the repetition periods at which the first and second periodic signal values S1 and S2 are calculated. This makes it possible to properly calculate the intake opening angle θlin and the exhaust reopening angle θrbl in synchronism with the timing in which the first and second periodic signal values S1 and S2 are positively calculated. Accordingly, during the control, e.g. even when the intake opening angle θlin and the exhaust reopening angle θrbl are separately largely changed in the same timing in response to a change in the target value Pmi_cmd, the first and second response indices RI1 and RI2 can be accurately calculated, whereby it is possible to cause the indicated mean effective pressure Pmi to accurately converge to its target value Pmi_cmd while avoiding a mutual interaction between the intake opening angle θlin and the exhaust reopening angle θrbl as control inputs, and causing the two control inputs to cooperate with each other. Further, even when the control system is in a steady state, it is possible to avoid the increasing/decreasing rate and the increasing/decreasing direction of each of the intake opening angle θlin and the exhaust reopening angle θrbl from being made oscillating by the adverse influence of the two periodic signal values, i.e. the first and second periodic signal values S1 and S2, thereby making it possible to ensure high-level stability of control.

It should be noted that although in the above-described embodiment, the control apparatus of the present invention controls a single controlled variable by two control inputs to the multi-input multi-output system, by way of example, this is not limitative, but the control apparatus of the present invention may be configured to control a single controlled variable by a single control input to the multi-input multi-output system, or a single controlled variable by three or more control inputs to the multi-input multi-output system. As described above, when the controlled variable Pmi is controlled by i (i=1 or i≧3) control input(s), the imaginary controlled variable Ym may be calculated based on a controlled object model which defines the relationships between the i control input(s) and the controlled variable Pmi, to calculate a control input Ui with control algorithms expressed by the following Equations (23) to (34):

$$Si(n) = Ai \cdot Si'(n) \tag{23}$$

$$Vi(n) = Si(n) + Ui(n) \tag{24}$$

$$Ymf(n) = b0 \cdot Ym(n) + b1 \cdot Ym(n-1) + \ldots + bm^* \cdot Ym(n-m^*) + a1 \cdot Ymf(n-1) + a2 \cdot Ymf(n-2) + \ldots + ak^* \cdot Ymf(n-k^*) \tag{25}$$

$$Sfi(n) = b0 \cdot Si(n) + b1 \cdot Si(n-1) + \ldots + bm^* \cdot Si(n-m^*) + a1 \cdot Sfi(n-1) + a2 \cdot Sfi(n-2) + \ldots + ak^* Sfi(n-k^*) \tag{26}$$

$$RIi(n) = Kri \cdot \sum_{j=n-b}^{n} Ymf(j) Sfi(j) \tag{27}$$

$$Ui(k) Urchi(k) + Uadpi(k) \tag{28}$$

$$Urchi(k) = -Krchi \cdot \sigma i(k) \tag{29}$$

$$Uadpi(k) = -Kadpi \cdot \sum_{j=0}^{k} \sigma i(j) \tag{30}$$

$$\sigma i(k) = Emi(k) + S \cdot Emi(k-1) \tag{31}$$

$$Emi(k) = \frac{RIi(k)}{\mathrm{RI}i_\max} \cdot Edi(k) \tag{32}$$

-continued $$Edi(k) = \frac{|RIi(k)|}{\sum_{j=1}^{m} |RIj(k)|} \cdot E(k) \tag{33}$$

$$E(k) = Pmi(k) - \mathrm{Pm}i_\mathrm{cmd}(k) \tag{34}$$

Further, although in the present embodiment, the response-specifying control algorithms are employed as control algorithms for causing the controlled variable to converge to its target value, by way of example, this is not limitative, but any algorithm, such as a general feedback control algorithm, may be used as a control algorithm of the present invention insofar as it is capable of causing the controlled variable to converge to its target value. For example, in place of the response-specifying control algorithm expressed by the aforementioned Equations (28) to (31), there may be employed a PID control algorithm expressed by the following Equations (35) to (38):

$$Ui(k)=UPi(k)+UIi(k)+UDi(k) \tag{35}$$

$$UPi(k)=KP \cdot Emi(k) \tag{36}$$

$$UIi(k)=UIi(k-1)+KI \cdot Emi(k) \tag{37}$$

$$UDi(k)=KD \cdot [Emi(k)-Emi(k-1)] \tag{38}$$

Furthermore, although in the present embodiment, the high-pass filters 48 to 50 for carrying out the high-pass filtering process are employed as the filter means, by way of example, this is not limitative, but the filter means of the present invention may be any means insofar as it filters a plurality of periodic signal values and an imaginary controlled variable so as to properly pass frequency components of periodic signal values while cutting frequency components of control inputs. For example, bandpass filters may be employed as the filter means. Further, when there is no need to cut frequency components of control inputs, the first and second periodic signal values S1 and S2 and the imaginary controlled variable Ym may be used as they are without being processed by the high-pass filters or the like, to thereby calculate the first and second response indices RI1 and RI2 based on values S1·Ym and S2·Ym obtained by multiplying the imaginary controlled variable Ym by the first and second periodic signal values S1 and S2.

Further, although in the present embodiment, values having a sine waveform are used as the first and second periodic signal values S1 and S2, by way of example, the periodic signal values of the present invention are not limited to these, but any suitable values, such as values having a cosine waveform or values having a sawtooth waveform, may be used insofar as they have a predetermined periodicity.

Further, although in the present embodiment, the first and second response indices RI1 and RI2 are used as the correlation parameters, by way of example, the correlation parameters are not limited to these, but any suitable correlation parameters may be used insofar as they represent respective correlations between the control inputs and the controlled variable in the controlled object model. For example, the response indices RI1 and RI2 may be calculated as the correlation parameters by calculating h+1 time-series data of values Ymf·Sf1 and Ymf·Sf2 obtained by multiplying the filtered value Ymf of the imaginary controlled variable by the filtered values Sf1 and Sf2 of the two periodic signal values, respectively, and multiplying the moving average value of the time-series data by the respective response gain correction coefficients Kr1 and Kr2.

Furthermore, although in the present embodiment, the first and second follow-up errors Em1 and Em2 are calculated by multiplying the first and second distributed errors Ed1 and Ed2 by the values RI1/RI1_max and RI2/RI2_max, respectively, by way of example, this is not limitative, but the first and second follow-up errors Em1 and Em2 may be calculated by multiplying the first and second distributed errors Ed1 and Ed2 by sign functions sgn (RI1) and sgn (RI2) of the first and second response indices RI1 and RI2.

Further, although in the present embodiment, the control apparatus 1 is applied to the engine 3 as the controlled object, by way of example, this is not limitative, but the control apparatus of the present invention may be applied to various industrial apparatuses and devices having extremal characteristics or of multi-input multi-output system type.

It is further understood by those skilled in the art that the foregoing are preferred embodiments of the invention, and that various changes and modifications may be made without departing from the spirit and scope thereof.

What is claimed is:

1. A control apparatus comprising: correlation parameter-calculating means for calculating a correlation parameter indicative of a correlation between a control input and a controlled variable in a controlled object based on a controlled object model defining a relationship between the control input and the controlled variable;

target value-setting means for setting a target value as a target of the controlled variable; and control input-calculating means for calculating the control input with a predetermined control algorithm such that the controlled variable is caused to converge to the target value, and determining at least one of an increasing/decreasing rate and an increasing/decreasing direction of the control input according to the correlation parameter, wherein the correlation parameter-calculating means comprises:

calculated control input-calculating means for calculating a calculated control input as time-series data at a predetermined repetition period, by adding a periodic signal value having a predetermined periodicity to the control input;

calculated controlled variable-calculating means for calculating an calculated controlled variable corresponding to the controlled variable to be obtained when the calculated control input is used as the control input to the controlled object model, as time-series data, based on the controlled object model at the predetermined repetition period; and parameter-calculating means for calculating a plurality of multiplied values by multiplying a plurality of time-series data of the calculated controlled variable by a plurality of time-series data of the periodic signal value, respectively, and calculating the correlation parameter at the predetermined repetition period based on a sum of the multiplied values.

2. A control apparatus as claimed in claim 1, wherein said correlation parameter-calculating means further comprises filter means for subjecting the periodic signal value and the calculated controlled variable to a predetermined filtering process, and wherein said parameter-calculating means calculates the multiplied values by multiplying the plurality of time-series data of the calculated controlled variable subjected to the predetermined filtering process, by the plurality of time-series data of the periodic signal value subjected to the predetermined filtering process, respectively.

3. A control apparatus as claimed in claim 1, wherein the controlled object is an internal combustion engine.

4. A control apparatus comprising: correlation parameter-calculating means for calculating a plurality of correlation parameters indicative of respective correlations between a plurality of control inputs and a controlled variable in a controlled object based on a controlled object model defining relationships between the control inputs and the controlled variable;

target value-setting means for setting a target value as a target of the controlled variable; and control input-calculating means for calculating each of the control inputs with a predetermined control algorithm such that the controlled variable is caused to converge to the target value, and determining at least one of an increasing/decreasing rate and an increasing/decreasing direction of each control input according to a corresponding one of the correlation parameters, wherein the correlation parameter-calculating means comprises:

calculated control input-calculating means for calculating a plurality of calculated control inputs as time-series data at a first predetermined repetition period by adding a plurality of periodic signal values having a predetermined periodicity to the control inputs, respectively;

calculated controlled variable-calculating means for calculating an calculated controlled variable corresponding to the controlled variable to be obtained when the calculated control inputs are used as the control inputs to the controlled object model, respectively, as time-series data, based on the controlled object model at the first repetition period; and parameter-calculating means for calculating a plurality of multiplied values by multiplying a plurality of time-series data of the calculated controlled variable by a plurality of time-series data of each of the periodic signal values, respectively, and calculating each of the correlation parameters at the first repetition period based on a sum of the multiplied values.

5. A control apparatus as claimed in claim 4, wherein the periodic signal values have a plurality of additional repetition periods different from each other wherein the second additional repetition periods are larger than the first repetition period and are set to integral multiples of the first repetition period, and wherein a repetition period at which said control input-calculating means calculates each control input is set to an integral multiple of a least common multiple of the second repetition periods.

6. A control apparatus as claimed in claim 4, wherein said correlation parameter-calculating means further comprises filter means for subjecting each periodic signal value and the calculated controlled variable to a predetermined filtering process, and wherein said parameter-calculating means calculates the multiplied values by multiplying the plurality of time-series data of the calculated controlled variable subjected to the predetermined filtering process, by the plurality of time-series data of each periodic signal value subjected to the predetermined filtering process, respectively.

7. A control apparatus as claimed in claim 4, wherein the controlled object is an internal combustion engine.

* * * * *